US006939717B2

(12) United States Patent
Jiang et al.

(10) Patent No.: US 6,939,717 B2
(45) Date of Patent: Sep. 6, 2005

(54) HYDROGEN SULPHIDE DETECTION METHOD AND APPARATUS

(75) Inventors: Li Jiang, Cambridge (GB); Timothy Gareth John Jones, Cottenham (GB); Oliver Clinton Mullins, Ridgefield, CT (US); Xu Wu, Beijing (CN)

(73) Assignee: Schlumberger Technology Corporation, Ridgefield, CT (US)

( * ) Notice: Subject to any disclaimer, the term of this patent is extended or adjusted under 35 U.S.C. 154(b) by 216 days.

(21) Appl. No.: 10/203,238

(22) PCT Filed: Feb. 15, 2001

(86) PCT No.: PCT/GB01/00611

§ 371 (c)(1),
(2), (4) Date: Dec. 2, 2002

(87) PCT Pub. No.: WO01/63094

PCT Pub. Date: Aug. 30, 2001

(65) Prior Publication Data

US 2003/0134426 A1 Jul. 17, 2003

(30) Foreign Application Priority Data

Feb. 26, 2000 (GB) ..... 0004604

(51) Int. Cl.[7] ..... G01N 33/00

(52) U.S. Cl. ..... 436/121; 436/25; 436/30; 436/32

(58) Field of Search ..... 436/121; 166/150.01, 166/250.05, 250.11, 264; 73/19.01, 19.09, 23.38, 23.41

(56) References Cited

U.S. PATENT DOCUMENTS

| | | | | |
|---|---|---|---|---|
| 3,780,575 A | | 12/1973 | Urbanosky | |
| 3,859,851 A | | 1/1975 | Urbanosky | |
| 4,154,659 A | | 5/1979 | Zetter | |
| 4,605,065 A | * | 8/1986 | Abercrombie | 166/250.11 |
| 4,678,756 A | | 7/1987 | Parks | |
| 4,994,671 A | | 2/1991 | Safinya et al. | |
| 5,289,875 A | | 3/1994 | Stokley et al. | |
| 5,303,775 A | | 4/1994 | Michaels et al. | |
| 5,329,811 A | | 7/1994 | Schultz et al. | |
| 5,337,822 A | | 8/1994 | Massie et al. | |
| 5,351,532 A | | 10/1994 | Hager | |
| 5,397,708 A | | 3/1995 | Lessard et al. | |
| 5,529,841 A | | 6/1996 | Neihof | |
| 5,627,749 A | | 5/1997 | Waterman et al. | |
| 5,635,631 A | | 6/1997 | Yesudas et al. | |
| 5,859,430 A | | 1/1999 | Mullins et al. | |
| 6,218,662 B1 | * | 4/2001 | Tchakarov et al. | 250/256 |
| 6,223,822 B1 | | 5/2001 | Jones | |

FOREIGN PATENT DOCUMENTS

| | | | | |
|---|---|---|---|---|
| GB | 1 495 284 | | 12/1977 | |
| GB | 2 344 365 | | 1/2001 | |
| GB | 2 371 621 A | | 7/2002 | |
| JP | 2001318167 A | * | 11/2001 | G01V/9/00 |
| WO | 99/00575 | | 1/1999 | |

OTHER PUBLICATIONS

Metal Samples/Cortest by Metal Samples/Cortest Instrument Systems, a division of Alabama Specialty Products, Inc.

Metal Samples by Metal Samples Company, a division of Alabama Specialty Products, Inc.

(Continued)

*Primary Examiner*—Yelena G. Gakh
(74) *Attorney, Agent, or Firm*—Christophe Macquet; William L. Wang; William B. Batzer

(57) ABSTRACT

Described is a downhole method and apparatus for detecting hydrogen sulphide in formation fluids produced in a hydrocarbon well. The sensor system is located within or in communication with an extraction chamber used to extract hydrogen sulphide in a gaseous state from the formation fluid and preferably equipped with renewable sensing elements.

9 Claims, 5 Drawing Sheets

OTHER PUBLICATIONS

Tissot, B.P. and Welte, D.H., "Geochemical regularities in relation to thermal evolution", Petroleum Formation and Occurrence, 2nd edition, Springer–Verlag, Berlin, 1984, pp. 453–455.

Carlson, M.R. and Cawston, W.B., "Obtaining PVT data for very sour retrograde condensate gas and volatile oil reservoirs: A multi–disciplinary approach", SPE Gas Tech. Conf., Calgary, 1996, SPE 35653.

Dosher, J.R. and Carney, J.T., "Sulfur increase seen mostly in heavy fractions of lower–quality crudes", Oil and Gas Journal, 92, 1994, pp. 43–48.

Goar, B.G. and Nasato, E., "Large–plant sulfur recovery processes stress efficiency", Oil and Gas Journal, 92, 1994, pp. 61–67.

Håland, K., Barrufet, M. A., Rønningsen, H.P. and Meisingset, K.K., "An empirical correlation between reservoir temperature and the concentration of hydrogen sulfide", SPE Int. Symp. on Oilfield Chem., Houston, Texas, Feb., 1999, SPE 50763.

Orr, W.L. and Sinninghe Damsté, J.S., "Geochemistry of sulfur in petroleum systems", Geochemistry of Sulfur in Fossil Fuels, (W.L. Orr and C.M. White, eds.), ACS Symposium Series 429, American Chemical Society, Washington D.C., 1990, pp. 2–29.

Scott, P.J.B. and Davies, M., "Souring of New Irian Jaya wells traced to indigenous bacteria", Oil and Gas Journal, 91, 1993, pp. 47–50.

Aplin, A.C. and Coleman, M.L., "Sour gas and water chemistry of the Bridport Sands reservoir, Wytch Farm, UK", The Geochemistry of Reservoirs, (J.M. Cubitt and W.A. England, eds.), Geol. Soc. Special Publication 86, The Geological Society, London, 1995, pp. 303–314.

Kalpakci, B., Magri, N.F., Ravenscroft, P.D., McTier, M.D.K. and Arf, G.T., "Mitigation of reservoir souring—decision process", SPE Int. Symp.on Oilfield Chem., San Antonio, Texas, Feb. 1995, SPE 28947.

Badry, R., Head, E., Morris, C. and Traboulay, I., "New wireline formation tester techniques and applications", Trans. SPWLA 34th Ann. Loggin Symp., Calgary, Jun. 1993, paper ZZ.

Schlumberger Wireline and Testing, "Sampling", Schlumberger Wireline Formation Testing and Sampling, Houston, 1996, pp. 10–1 to 10–25.

Rhodes, H.L., "Determination of hydrogen sulfide content in natural gas, evaluation of containers for preparation of calibration standards, and sample collection procedure", US Department of the Interior, Bureau of Mines, Report of Investigations 8391, Washington 1979.

Burke, N.E., Chea, C.K, Hobbs, R.D. and Tran, H.T., "Extended analysis of live reservoir oils by gas chromatography", SPE Int. Symposium on Oilfield Chem., Anaheim, California, Feb. 1991, SPE 21003.

Cutter, G.A. and Oatts, T.J., "Determination of dissolved sulfide and sedimentary sulfur speciation using gas chromatography–photoionization detection", Analytical Chemistry, 59, 1987, pp. 717–721; Cutter, G.A. and Krahforst, C.F., "Sulfide in surface waters of the western Atlantic Ocean", Geophysical Research Letters, 15, 1988, pp. 1393–1396.

Radford–Knœry, J. and Cutter, G.A., "Determination of carbonyl sulfide and hydrogen sulfide species in natural waters using specialized collection procedures and gas chromatography with flame photometric detection", Analytical Chemistry, 65, 1993, pp. 976–982.

Devai, I. and DeLaune, R.D., "Changes in reduced gaseous sulfur compounds collected in glass sampling bulbs", Analytical Letters., 27(12), 1994, pp. 2403–2411.

Bethea, R.M., "Comparison of hydrogen sulfide analysis techniques", Journal of the Air Pollution Control Association, 23, 1973, pp. 710–713.

Masselter, S.M., Zemann, A.J. and Bonn, G.K., "Determination of inorganic anions in Kraft pulping liquors by capillary electrophoresis", J. High Resol. Chromatogr., 19, 1996, pp. 131–136.

Font, J., Gutierrez, J., Lalueza, J. and Perez, X., "Determination of sulfide in the leather industry by capillary electrophoresis", Journal of Chromatography A., 740, 1996, pp. 125–132.

Yashin, A.Y. and Belyamova, T.T., "Simultaneous determination of sulfide, iodide and rhodanide by ion chromatography with the use of an amperometric detector", Journal of Analytical Chemistry, 53, 1998, pp. 344–346.

Hassan, S.M., "Sulfur speciation: methodology and application to sulfide oxidation studies at the sediment–water interface", Chemosphere, vol. 29, No 12, 1994, pp. 2555–2569.

Nagashima, K., Fukushima, K. and Kamaya, M., "Determination of trace amounts of sulfide in human serum by high–performance liquid chromatography with fluorometric detection after derivatization with 2–amino–5–N,N–diethylaminotoluene and iron(III)", Journal of Liquid Chromatography, 18(3), 1995, pp. 515–526.

Garrett, R.L., "A new field method for the quantitative determination of sulfides in water–base drilling fluids", Journal of Petroleum Technology, Sep. 1977, pp. 1195–1202.

American Petroleum Institute, "Recommended practice standard procedure for field testing water–based drilling fluids", API Recommended Practice 13B–1 (RP 13B–1), First edition, Jun. 1990.

Barrett, E.P.S., Georgiades, G.C. and Sermon, P.A., "The mechanism of operation of $WO_3$–based $H_2S$ sensors", Sensors and Actuators, B1, 1990, pp. 116–120.

Tamaki, J., Maekawa, T., Miura, N. and Yamazoe, N., "CuO–$SnO_2$ element for highly sensitive and selective detection of $H_2S$", Sensors and Actuators B, 9, 1992, pp. 197–203.

Sberveglieri, G., Groppelli, S., Nelli, P., Perego, C., Valdré, G. and Camanzi, A., "Detection of sub–ppm $H_2S$ concentrations by means of $SnO_2$(Pt) thin films, grown by the RGTO technique", Sensors and Actuators B, 15–16, 1993, pp. 86–89.

Mochida, T., Kikuchi, K., Kondo, T., Ueno, H. and Matsuura, Y., "Highly sensitive and selective $H_2S$ gas sensor from r.f. sputtered $SnO_2$ thin film", Sensors and Actuators B 24–25, 1995, pp. 433–437.

Galipeau, J.D., Falconer, R.S., Vetelino, J.F., Caron, J.J., Wittman, E.L., Schweyer, M.G. and Andle, J.C., "Theory, design and operation of a surface acoustic wave hydrogen sulfide microsensor", Sensors and Actuators B 24–25, 1995, pp. 49–53.

Schiavon, G., Zotti, G., Toniolo, R. and Bontempelli, G., "Electrochemical detection of trace hydrogen sulfide in gaseous samples by porous silver electrodes supported on ion–exchange membranes (solid polymer electrolytes)", Analytical Chemistry, 67, 1995, pp. 318–323.

Hart, J.P. and Abass, A.K., "A disposable amperometric gas sensor for sulphur–containing compounds based on a chemically modified screen printed carbon electrode coated with a hydrogel", Analytica Chimica Acta, 342, 1997, pp. 199–206.

Revsbech, N.P., Jørgensen, B.B. and Blackburn, T.H., "Microelectrode studies of the photosynthesis and $O_2$, $H_2S$ and pH profiles of a microbial mat", Limnol. Oceanogr., 28(6), 1983, pp. 1062–1074.

Vivit, D.V., Ball, J.W. and Jenne, E.A., "Specific–ion electrode determinations of sulfide preconcentrated from San Francisco Bay Waters", Environ. Geol. Water Sci., vol. 6, No 2, 1984, pp. 79–90.

Eckert, W., Frevert, T. and Trüper, H.G., "A new liquid–junction free probe for the in situ determination of pH, $pH_2S$ and redox values", Wat. Res., vol. 24, No 11, 1990, pp. 1341–1346.

Dobcnik, D., Gomiscek, S. and Stergulec, J., "Preparation of a sulphide ion–selective microelectrode with chemical pretreatment of silver wire in Hg(II) solution", Fresenius' Journal of Analytical Chemistry, 337, 1990, pp. 369–371.

Rey, J.R., Shaffer, J., Kain, T., Stahl, R. and Crossman, R., "Sulfide variation in the pore and surface waters of artificial salt–marsh ditches and a natural tidal creek", Estuaries, vol. 15, No 3, 1992, pp. 257–269.

Brouwer, H. and Murphy, T.P., "Diffusion method for the determination of acid–volatile sulfides (AVS) in sediment", Environmental Toxicology and Chemistry, vol. 13, No 8, 1994, pp. 1273–1275.

Hu, X. and Leng, Z., "Determination of trace–levels of sulfide by high–sensitivity potentiometry with a carbon paste electrode", Analytical Communications, 33, 1996, pp. 297–298.

Hadden, D.M., "A system for continuous on–site measurement of sulfides in water–base drilling muds", SPE Sour Gas Symp., Tyler, Texas, Nov. 1977, SPE 6664.

Jeroschewski, P., Haase, K., Trommer, A. and Gründler, P., "Galvanic sensor for the determination of hydrogen sulphide/sulphide in aqueous media", Fresenius' Journal of Analytical Chemistry, 346, 1993, pp. 930–933; Jeroschewski, P., Haase, K., Trommer, A. and Gründer, P., "Galvanic sensor for determination of hydrogen sulfide", Electroanalysis, 6, 1994, pp. 769–772; Jeroschewski, P., Steuckart, C. and Kuhl, M., "An amperometric microsensor for the determination of $H_2S$ in aquatic environments", Analytical Chemistry, 68, 1996, pp. 4351–4357.

Ma, Y.L., Galal, A., Zimmer, H., Mark, H.B., Huang, Z.F. and Bishop, P.L., "Potentiometric selective determination of hydrogen sulfide by an electropolymerized membrane electrode based on binaphthyl–20–crown–6", Analytical Chimica Acta, 289, 1994, pp. 21–26.

Atta, N.F., Galal, A., Mark, H.B., Yu, T and Bishop, P.L., "Conducting polymer ion sensor electrodes –III. Potentiometric sulfide ion selective electrode", Talanta, 47, 1998, pp. 987–999.

Opekar, F. and Bruckenstein, S., "Determination of gaseous hydrogen sulfide by cathodic stripping voltammetry after preconcentration on a silver metalized porous membrane electrode", Analytical Chemistry, vol. 56, No 8, 1984, pp. 1206–1209.

Kirchnerova, J., Bale, C.W. and Skeaff, J.M., "Potentiometric gaseous sulfur sensor based on silver beta–alumina solid electrolyte", Solid State Ionics 91, 1996, pp. 257–264.

Weldon, V., O'Gorman, J., Phelan, P., Hegarty, J. and Tanbun–Ek, T., "$H_2S$ and $CO_2$ gas sensing using DFB laser diodes emitting at 1.57 $\mu$m", Sensors and Actuators B 29, 1995, pp. 101–107.

Smits, A.R., Fincher, D.V., Nishida, K., Mullins, O.C., Schroeder, R.J. and Yamate, T., "In–situ optical fluid analysis as an aid to wireline formation sampling", SPE Formation Evaluation, 10, 1995, pp. 91–98.

Arowolo, T.A. and Cresser, M.S., "Automated determination of sulphide by gas–phase molecular absorption spectrometry", Analyst, 116, 1991, pp. 595–599.

Howard, A.G. and Yeh, C.Y., "Sulfide measurement by flow injection analysis with flame photometric detection", Analytical Chemistry, 70, 1998, pp. 4868–4872.

Saltzman, R.S. and Leonard, L.M., "Sulfur recovery tail gas analyses with a process diode array analyzer", Paper #91–0408, 1991.

Suleimenov, O.M. and Seward, T.M., "A spectrophotometric study of hydrogen sulphide ionisation in aqueous solutions to 350° C.", Geochimica et Cosmochimica Acta, vol. 61, No 24, 1997, pp. 5187–5198.

Cline, J.D., "Spectrophotometric determination of hydrogen sulfide in natural waters", Limnol. Oceaonogr., 14, 1969, pp. 454–458.

Francom, D., Goodwin, L.R. and Dieken, F.P., "Determination of low level sulfides in environmental waters by automated gas dialysis/methylene blue colorimetry", Analytical Letters, 22(11&12), 1989, pp. 2587–2600.

Kubán, V., Dasgupta, P.K. and Marx, J.N., "Nitroprusside and methylene blue methods for silicone membrane differentiated flow injection determination of sulfide in water and wastewater", Analytical Chemistry, 64, 1992, pp. 36–43.

Habicht, K.S. and Canfield, D.E., "Sulfur isotope fractionation during bacterial sulfate reduction in organic–rich sediments", Geochimica et Cosmochimica Acta, vol. 61, No 24, 1997, pp. 5351–5361.

Spaziani, M.A., Davis, J.L., Tinani, M. and Carroll, M.K., "On–line determination of sulfide by the 'methylene blue method' with diode–laser–based fluorescence detection", Analyst, 122, 1997, pp. 1555–1557.

Phillips, B.M., Anderson, B.S. and Hunt, J.W., "Measurement and distribution of interstitial and overlying water ammonia and hydrogen sulfide in sediment toxicity tests", Marine Environmental Research, vol. 44, No 2, 1997, pp. 117–126.

Koh, T., Takahashi, N., Yamamuro, N. and Miura, Y., "Spectrophotometric determination of sulfide at the $10^{-6}$ mol $l^{-1}$ level by formation of thiocyanate and its solvent extraction with methylene blue", Analytical Sciences, 9, 1993, pp. 487–492.

Mousavi, M.F. and Sarlack, N., "Spectrophotometric determination of trace amounts of sulfide ion based on its catalytic reduction reaction with methylene blue in the presence of Te(IV)", Analytical Letters, 30(8), 1997, pp. 1567–1578.

Shanthi, K. and Balasubramanian, N., "Method for sampling and analysis of hydrogen sulfide", Analyst, 121, 1996, pp. 647–650.

Narayanaswamy, R. and Sevilla, F., "Optosensing of hydrogen sulphide through paper impregnated with lead acetate", Fresenius' Z. Anal. Chem., 329, 1988, pp. 789–792.

Eroglu, A.E., Volkan, M., Bayramh, E., Ataman, O.Y. and Mark, H.B., "Hydrogen sulfide determination by solid surface luminescence", Fresenius' Journal of Analytical Chemistry, 355, 1996, pp. 667–671.
Volkan, M., Eroglu, T., Eroglu, A.E., Ataman, O.Y. and Mark, H.B., "A novel sorbent tube for ambient hydrogen sulfide determination", Talanta, 47, 1998, pp. 585–593.
Cardoso, A.A., Liu, H. and Dasgupta, P.K., "Fluorometric fiber optic drop sensor for atmospheric hydrogen sulfide", Talanta, 44, 1997, pp. 1099–1106.
Choi, M.M.F., "Fluorimetric optode membrane for sulfide detection", Analyst, 123, 1998, pp. 1631–1634.
Hachenberg, H. and Schmidt, A.P., "Analytical applications", Gas Chromatography Headspace Analysis, Wiley, 1984, pp. 1–78.
Ioffe, B.V. and Vitenberg, A.G., "Theory of gas–chromatographic head–space analysis", Head–Space Analysis and Related Methods in Gas Chromatography, Wiley–Interscience, 1984, pp. 9–66.
Kolb, B. and Ettre, L.S., "Principles of headspace analysis", Static Headspace–Gas Chromatography, Theory and Practice, Wiley–VCH, 1997, pp. 1–11.
Vitenberg, A.G., Kuznetsova, L.M., Butaeva, I.L. and Inshakov, M.D., "Gas chromatographic determination of trace amounts of sulfur compounds in industrial effluents", Analytical Chemistry, vol. 49, No 1, 1977, pp. 128–133.
Brunner, U., Chasteen, T.G., Ferloni, P. and Bachofen, R., "Chromatographic determination of phosphine ($PH_3$) and hydrogen sulfide ($H_2S$) in the headspace of anaerobic bacterial enrichments using flame photometric detection", Chromatographia, vol. 40, No 7/8, 1995, pp. 399–403.
Ramstad, T., Bates, A.H., Yellig, T.J., Borchert, S.J. and Mills, K.A., "Analysis of hydrogen sulfide gas from a pharmaceutical drug formulation by cryofocused headspace gas chromatography", Analyst, 120, 1995, pp. 2775–2780.
Kolb, B. and Ettre, L.S., "Special measurements", Static Headspace–Gas Chromatography, Theory and Practice, Wiley–VCH, 1997, pp. 268–270.
Kurosawa, H., Hirano, T., Nakamura, K. and Amano, Y., "Microbial sensor for selective determination of sulphide", Appl. Microbiol. Biotechnol., 41, 1994, pp. 556–559.
Dake, L.P., "The appraisal of oil and gas fields", The practice of reservoir engineering, Elsevier, 1994, pp. 29–44.
Tremper, K.K. and Prausnitz, J.M., "Solubility of inorganic gases in high–boiling hydrocarbon solvents", Journal of Chemical and Engineering Data, vol. 21, No 3, 1976, pp. 295–299.
King, M.B. and Al–Najjar, H., "The solubilities of carbon dioxide, hydrogen sulphide and propane in some normal alkane solvents—I", Chemical Engineering Science, 32, 1977, pp. 1241–1246.
Yokoyama, C., Usui, A. and Takahashi, S., "Solubility of hydrogen sulfide in isooctane, n–decane, n–tridecane, n–hexadecane and squalane at temperatures from 323 to 523 K and pressures up to 1.6 MPa", Fluid Phase Equilibria, 85, 1993, pp. 257–269.
Feng, G–X. and Mather, A.E., "Solubility of hydrogen sulfide in n–eicosane at elevated pressure", J. Chem. Eng. Data, 37, 1992, pp. 412–413; Feng, G–X. and Mather, A.E., "Solubility of $H_2S$ in n–dodecane", Fluid Phase Equilibria, 87, 1993, pp. 341–346; Feng, G–X. and Mather, A.E., "Solubility of $H_2S$ in n–hexadecane at elevated pressure", Canadian Journal of Chemical Engineering 71, 1993, pp. 327–328; Feng, G–X., Mather, A.E. and Carroll, J.J., "The solubility of hydrogen sulfide in mixtures of n–hexadecane and n–eicosane", Canadian Journal of Chemical Engineering, 73, 1995, pp. 154–155.
Carroll, J.J. and Mather, A.E., "The solubility of hydrogen sulphide in water from 0 to 90° C. and pressures to 1 MPa", Geochimica et Cosmochimica Acta, 53, 1989, pp. 1163–1170.
Myers, R.J., "The new low value for the second dissociation constant for $H_2S$", Journal of Chemical Education, 1986, vol. 63, No 8, pp. 687–690.
Shorthouse, G. and Peat, R., "Down hole chemical sensors for sub–sea oil wells", MST News, 2, 1998, pp. 12–13.
Bates, R.G., "The glass electrode", Reference Electrodes, Theory and Practice, Academic Press, 1961, pp. 238–240.
Quinn, R. and Laciak, D.V., "Polyelectrolyte membranes for acid gas separations", Journal of Membrane Science, 131, 1997, pp. 49–60.
Stern, S.A. and Bhide, B.D., "Permeability of silicone polymers to ammonia and hydrogen sulfide", Journal of Applied Polymer Science, 38, 1989, pp. 2131–2147.

* cited by examiner

HYDROGEN SULPHIDE DETECTION METHOD AND APPARATUS

This invention relates to apparatus and methods for determining the presence or the amount of hydrogen sulphide in fluids produced from subterranean formations. Particularly, the invention relates to such apparatus and methods applicable within a wellbore penetrating the subterranean formations.

BACKGROUND OF THE INVENTION

The hydrogen sulphide content of fluids in the permeable formations of oil wells has an important impact on the economic value of the produced hydrocarbons and production operations. Typically, the sulphur content of crude oils is in the range 0.3–0.8 weight percent and the hydrogen sulphide content of natural gas is in the range 0.01–0.4 weight percent(1), although concentrations of hydrogen sulphide in natural gas of up to 30 weight percent have been reported(2) Several recent reports(3,4) have claimed a systematic increase in the sulphur content of crude oils over the past 10–20 years and anticipate further significant increases in the concentration of hydrogen sulphide in both oil and natural gas. Håland et al.(5) have recently found a correlation between the hydrogen sulphide concentration of produced hydrocarbons from the Norwegian continental shelf and the reservoir temperature; above about 110° C., the hydrogen sulphide content of produced hydrocarbons was observed to increase exponentially with temperature, while below this temperature the hydrogen sulphide concentration was negligible. Orr and Sinninghe Damsté(6) have given a recent review of the geochemistry of sulphur in naturally-occurring hydrocarbons.

The presence of hydrogen sulphide in produced fluids can give rise to critical safety problems. The exposure limit recommended by the US National Institute for Occupational Health is 10 ppm per 10 minutes of exposure. The gas is immediately lethal at a concentration of about 300 ppm, which is comparable to the toxicity of hydrogen cyanide. The human nose can detect concentrations as low as 0.02 ppm and its maximum sensitivity is about 5 ppm; the nose becomes increasingly unable to detect hydrogen sulphide at concentrations of 150–200 ppm. Detection limits below about 5 ppm are therefore desirable.

The hydrogen sulphide content of oilfield brines and produced water can also give rise to significant production problems. The breakthrough of seawater during the secondary recovery of hydrocarbons can give rise to the enhanced production of hydrogen sulphide by the action of sulphate-reducing bacteria on the sulphate in the seawater. Scott and Davies(7), Aplin and Coleman(8) and Kalpakci et al.(9) have recently discussed the formation of hydrogen sulphide by the action of sulphate-reducing bacteria in oil wells which co-produce water containing high sulphate concentrations.

The hydrogen sulphide content of reservoir fluids can be determined from samples collected by wireline fluid sampling tools such as Schlumberger's Modular Dynamics Tester(10,11) or related sampling tools(12,13). Fluid samples are usually collected in metal containers, which are able to maintain the pressures at which the samples were collected. A well known problem associated with sampling fluids containing hydrogen sulphide is partial loss of the gas by reaction of the metal components, particularly those made from iron-based metals(14–16). The hydrogen sulphide gas readily forms non-volatile and insoluble metal sulphides by reaction with many metals and metal oxides, and analysis of the fluid samples can therefore give an underestimate of the true sulphide content.

It is therefore an object of this invention to describe the application of several sensors concepts for the measurement of the hydrogen sulphide concentration of samples collected by a wireline fluid sampling tool.

A large number of laboratory techniques exist for the measurement of hydrogen sulphide in samples of fluids of either geological or environmental interest, collected by sub-surface sampling tools or from fluid streams at the surface. Reservoir fluids can be collected and stored at reservoir pressures by wireline sampling tools, such as Schlumberger's MDT (Mark of Schlumberger) tool(10,11) or the single-phase hydrocarbon sampling tool described by Massie et al.(17). Burke et al.(18) have described the use of gas chromatography to analyse the samples of pressured reservoir oil samples captured by wireline sampling tools. The hydrogen sulphide contents of the oil samples, together with the concentrations of the hydrocarbons $C_1$ to $C_7$ and the gases oxygen, nitrogen and carbon dioxide, were measured by a gas chromatograph using a thermal conductivity detector. Cutter and coworkers(19,20) have described the use of gas chromatography with a photoionisation detector to analyse the soluble sulphide content of freshwater and marine water and sediment samples. The water samples were acidified to convert all soluble sulphide to hydrogen, sulphide, which was then stripped from solution by a stream of helium gas. Devai and DeLaune(21) have used gas chromatography to separate and quantify mixtures of sulphur-containing compounds, such as hydrogen sulphide, carbon disulphide and dimethyl sulphide. Bethea(22) has reviewed the early use of gas chromatography to analyse samples containing hydrogen sulphide.

Separation techniques have also been used to quantify the concentration of sulphide in liquid (aqueous) samples. Masselter et al.(23) have used capillary ion electrophoresis to determine the sulphide ion concentration in the liquors produced during the manufacture of paper and paper pulp. Sulphide ions were separated from other anions (chloride, sulphate, sulphite, oxalate, carbonate and thiosulphate) at a pH of 11.0 using a carrier phase consisting of sodium chromate, acetonitrile and a cationic polymer. The electrophoretic method gave a linear response between sulphide concentration and peak area over the range 1–100 ppm. Font et al.(24) have used capillary electrophoresis to determine the concentration of sulphide ions in waste water samples from the leather industry. The detection limit for sulphide ions in the effluent samples was determined to be 10 $\mu$g/l (10 ppb) using the direct absorption of ultraviolet light at a wavelength of 229 nm as the detection method. Yashin and Belyamova(25) demonstrated the use of an amperometric detector for the quantification of sulphide ions in aqueous solution by ion chromatography. Sulphide ions were readily separated from iodide and thiocyanide ions using a mobile phase consisting of sodium chloride and sodium hydrogen-phosphate (pH=6.7) and an applied redox potential of 1.3 V. The detection limit of sulphide ions in this matrix was determined to be 20 $\mu$g/l (20 ppb). Hassan(26) used ion chromatography to determine the concentration of sulphide ions in aqueous solutions in the presence of sulphate, sulphite and thiosulphate ions. The mobile phase consisted of a borate-gluconate buffer (pH=8.5) containing EDTA and ascorbic acid to prevent oxidation of the sulphite ions. The ions were separated using a commercial anion exchange column and detected with either conductivity or uv/vis detectors. The detection limit of sulphide in the aqueous matrix was 10 ppm. Nagashima et al.(27) developed a liquid chromatographic method to determine the concentration of sulphide ions in human blood samples. The sulphide ions were reacted with 2-amino-5-N,N-diethylaminotoluene and Fe(III) ions under acidic conditions to form a methylene blue derivative, which was separated from the reaction mixture by liquid chromatography and detected by fluorescence (excited at $\lambda$=640 nm and detected at $\lambda$=675 nm). A linear relationship between sulphide ion concentration and fluorescence intensity was observed over the concentration range 15–1500 ng/l (0.015–1.5 ppb).

Kalpakci et al.(9) recommended that, where possible, the hydrogen sulphide content of oilfield fluid samples should be determined on site, largely to avoid the problems of loss by reaction with metal components in the sample containers. Kalpakci et al. suggested two methods to analyse the hydrogen sulphide content of gas samples. The first method used a Dräger tube in which the sample of hydrogen sulphide gas was carried by an inert gas (e.g., nitrogen) and where it reacted with a coating on the wall of the tube to produce a colour change; the length of tube showing the colour change was directly proportional to the concentration of hydrogen sulphide(28,29). The second method used specific hydrogen sulphide gas sensors and these may be either solid-state metal oxide sensors (see refs. 30–33, for example), surface acoustic wave(34) and electrochemical sensors(35,36). These methods can also be used to determine the hydrogen sulphide content of liquid samples which are purged with a stream of inert gas; the pH of aqueous samples must be less than a value of 5 to ensure all soluble sulphides exist as hydrogen sulphide.

Electrochemical methods, particularly potentiometric methods, have been used widely to determine the concentration of sulphide dissolved in aqueous solutions. Silver/silver chloride electrodes have been used for many years to measure the concentration of sulphide ions ($HS^-$ and $S^{2-}$) in aqueous media at pH values typically in the range 7–12 (37–42). Hu and Leng(43) have used a carbon paste electrode prepared with diisooctyl phthalate to determine the concentration of sulphide ions ($HS^-$) in aqueous solutions buffered to a pH value of 9.00 using sodium tetraborate. The carbon paste electrode gave responses of 135–180 mV/decade and 40–60 mV/decade over the concentration ranges $1.5\times10^{-7}$–$2.5\times10^{-6}$ molar (5–85 ppb) and $7.0\times10^{-6}$–$1.0\times10^{-3}$ molar (0.24–34 ppm), respectively, using a saturated calomel reference electrode. The response of the carbon paste electrode was therefore considerably greater than the Nernstian response (30 mV/decade) of a conventional silver/silver sulphide electrode. Hu and Leng observed that the response of the carbon paste electrode to sulphide ions showed no significant dependence on the concentration of cyanide and iodide ions, in contrast to conventional silver/silver sulphide electrodes. Hadden(44) has described the use of combined silver/silver sulphide and pH electrodes to monitor the soluble sulphide content in water-based drilling fluids. Jeroschewski et al.(45) have described an amperometric gas sensor to determine the concentration of hydrogen sulphide in aqueous media; the hydrogen sulphide diffused from the aqueous solution through a PTFE membrane and into an inner aqueous solution where it dissociated to form $HS^-$ ions, which were subsequently oxidised by ferricyanide ions. Ma et al.(46) have described a potentiometric method of measuring the concentration of $HS^-$ ions in aqueous solutions using a membrane electrode produced by the electropolymerisation of binaphthyl-20-crown-6. The electrode showed typical linear behaviour over the concentration range $2\times10^{-7}$ to $2\times10^{-5}$ molar (7–700 ppb) and a detection limit of about $5\times10^{-8}$ molar (2 ppb) at a pH value of 7.5. Atta et al.(47) have developed a sulphide selective electrode formed by electrochemically depositing a film of poly(3-methylthiophene) and poly(dibenzo-18-crown-6) on a metal alloy electrode. The electrode gave an approximately Nernstian response over the range of sulphide ion concentration of $1.0\times10^{-7}$ to $1.0\times10^{-2}$ molar (3 ppb-320 ppm) and over the temperature range 10–40° C. Surprisingly, the electrode response showed little variation over the pH range 1–13 for sulphide ion concentrations in excess of about $10^{-5}$ molar.

Opekar and Bruckenstein(48) have developed a cathode stripping voltammetry technique to determine the concentration of hydrogen sulphide in a flowing stream of gas. The hydrogen sulphide was reacted with silver metal deposited in a porous PTFE membrane under a constant potential of −0.2 V, measured with respect to the saturated calomel electrode. Silver sulphide was formed in the membrane with the gas flowed at a known flow rate for a fixed period of time. The silver sulphide was removed from the electrode at a fixed potential of −0.9 V (with respect to the saturated calomel electrode) using a high flow rate of sulphide-free nitrogen (or air); the measured current was observed to be linear in the hydrogen sulphide concentration over the range 2.5–18 ppb. Kirchnervona et al.(49) fabricated a potentiometric hydrogen sulphide gas sensor for use in the temperature range 635–770° C. The potentiometric sensor consisted of a silver -□- alumina membrane with a silver reference electrode and a silver sulphide/molybdenum sulphide working electrode. The sensor measured the activity of elemental sulphur in the gas phase in an inert carrier gas (e.g., nitrogen) and at high temperatures this is provided by the dissociation of hydrogen sulphide. The low thermal stability of silver sulphide limited the detection limit for hydrogen sulphide to 10 ppm.

Numerous optical and wet chemical methods exist to measure the concentration of hydrogen sulphide, either in gaseous form or in aqueous solutions. Some of the classical wet chemical methods to determine the concentration of hydrogen sulphide in aqueous solutions have been compared by Bethea(22).

Weldon et al.(50) have developed a spectrophotometric method for measuring the concentration of hydrogen sulphide using the near-infrared absorption of the S—H combination band at a wavelength of 1590 nm. The near-infrared source was a distributed feedback laser and concentrations as low as 10 ppm at ambient pressures could be measured with an optical path length of 5 meters. Smits et al.(51) have described a near-infrared spectrometer for use in a wireline fluid sampling tool to differentiate hydrocarbon and brine samples and to detect the presence of gas. The optical path length of the spectrometer is of the order of 1 mm, which is insufficient to allow the detection and quantification of hydrogen sulphide in most wellbore fluid samples. Arowolo and Cresser(52) developed a method to measure the concentration of hydrogen sulphide in aqueous solutions by extracting the gas after acidifying the test solution with 3 molar hydrochloric acid and measuring the optical density (absorption) of the gas in an optical cell at a wavelength of 200 nm. An optical pathlength of 13 cm allowed a detection limit of 60 ppb sulphide in aqueous solutions; a linear relationship between absorbance and hydrogen sulphide concentration was observed up to a sulphide concentration of 100 ppm. Howard and Yeh(53) have developed a similar technique to determine the sulphide ion concentration of aqueous samples, although the detection system was based on a flame photometric detector. The flame emission was measured using a broad-band photomultiplier tube, which enabled a detection limit of 70 ppb to be achieved for sulphide dissolved in water. Over the concentration range 200–1700 ppb the photomultiplier output increased with the square of the concentration of sulphide in aqueous solutions.

Saltzman and Leonard(54) have described the use of a diode array ultraviolet/visible spectrophotometer to measure the concentration of various sulphur-containing gases, including hydrogen sulphide; the spectrophotometer is commercially available and manufactured by Ametek® (Newark, Del., USA). Suleimenov and Seward(55) have measured the far-ultraviolet spectra of aqueous solutions of hydrosulphide ions ($HS^-$) over the temperature range 25–350° C. at the saturated vapour pressure of water; the intense spectrum arises from charge transfer processes between $HS^-$ and water. Parks(56) has described a method of measuring the concentration of hydrogen sulphide by reaction with ozone to generate an electronically excited state of sulphur dioxide, which decayed to the ground state by the emission of radiation. The integrated intensity of the chemiluminescence was used to determine the concentration of hydrogen sulphide.

Hager(57) has described methods of sampling hydrocarbons and selected chemicals from drilling fluids during the drilling process and measurement of their concentrations using fluorescence or absorption spectroscopy. The drilling fluid samples, which contain the chemical species derived from the drilled formations, are captured through a membrane filter, located in the bottom hole assembly as part of a measurement-while-drilling tool string, and transported to the optical detection system using a suitable solvent. Hager did not specify hydrogen sulphide as a chemical species analysed in the drilling fluid.

The concentration of hydrogen sulphide in aqueous solution has also been determined spectrophotometrically using the reaction between hydrogen sulphide and a mixture of iron(III) chloride and N,N-dimethyl-p-phenylenediamine to generate the dye methylene blue which can be determined spectrophotometrically at a wavelength of 660 nm (58–60). Habicht and Canfield(61) have used the methylene blue spectrophotometric technique to quantify the hydrogen sulphide content of microbe-rich sediments from several locations. Spaziani et al.(62) have recently described an on-line method to measure the concentration of sulphide ions by detecting the formation of methylene blue by fluorescence using a diode laser excitation source. Alternative spectrophotometric techniques using methylene blue have been used to measure the concentration of sulphide in aqueous solution. Phillips et al.(63) have measured the concentration of hydrogen sulphide in surface waters and the interstitial water in near-surface sediments using the formation of methylene blue. The methylene blue was determined spectrophotometrically at a wavelength of 680 nm and the detection limit for total sulphide content was 0.01 mg/l (10 ppb). Koh et al. (64) have described a method for measuring the concentration of sulphide ions ($S^{2-}$) from the formation of thiocyanide ions ($SCN^-$) in aqueous solution, by reaction with cyanide ions and hydrogen peroxide, and subsequent extraction of thiocyanide into 1,2-dichloroethane using methylene blue to form an ion pair. The methylene blue-thiocyanide ion pair was detected by a spectrophotometer operating at a wavelength of 657 nm. Mousavi and Sarlack (65) have used the reduction of methylene blue by hydrogen sulphide ions ($HS^-$) using tellurium(IV) ions as a catalyst. The reduced methylene blue species is colourless and the concentration of hydrogen sulphide ions was determined by the loss in the absorbance of methylene blue measured at a wavelength of 663 nm. Shanthi and Balusubramanian(66) described a spectrophotometric method to measure low concentrations of hydrogen sulphide using its oxidation of bromate ions to bromine, which subsequently reacted with the indicator 2',7'-dichlorofluorescein to form a dibromo compound detected at a wavelength of 535 nm.

Narayanaswamy and Sevilla(67) have described a detector for hydrogen sulphide in the gas phase that was based on the change in the reflectivity of paper soaked in lead acetate exposed to the gas. The change in the reflectivity of the paper at 580 nm gave the greatest sensitivity and allowed gas phase concentrations as low as 50 ppb to be determined. The change in reflectivity of the lead acetate paper after a fixed time of 10 seconds was found to give accurate and reproducible measurements of hydrogen sulphide concentration. Neihof(68) reported on the use of filter paper impregnated with lead acetate to determine the concentration of hydrogen sulphide in seawater containing a fire fighting foam. The concentration of hydrogen sulphide was estimated by human observation of the colour of the paper: barely detectable coloration at 2 ppm, darkening at 4 ppm, light brown coloration at 8 ppm which turned to dark brown at 20 ppm. The lead acetate paper was protected from direct contact with the seawater sample by the use of a silicone polymer film, which enabled the transport of the hydrogen sulphide to the lead acetate paper but not the seawater. Neihof(68) also described the use of lead acetate powder immobilised in a cured silicone polymer to estimate the concentration of hydrogen sulphide in crude oil samples by a colorimetric test. The silicone polymer allowed hydrogen sulphide to reach the lead acetate particles but not the liquid hydrocarbon. A second colorimetric indicator for hydrogen sulphide, a mixture of anhydrous copper sulphate and copper thiocyanate, was also immobilised in a silicone polymer film. The indicator became an increasingly intense grey-green colour as the hydrogen sulphide content of seawater samples was increased from 2 to 32 ppm.

Eroglu et al.(69) used the luminescence of the cadmium sulphide (CdS) particles formed when hydrogen sulphide in a gas stream contacted cadmium salts, such as cadmium chloride and cadmium acetate, on paper and various polymer surfaces. The excitation of the cadmium sulphide formed on the surfaces in the spectral region 300–350 nm gave well-defined emission spectra in the region 400–750 nm. The luminescence intensity was linear in the concentration of hydrogen sulphide in the range 0.03–3 ppm. Volkan et al. (70) constructed a sensor to measure the hydrogen sulphide content of air using a flow tube whose walls were coated with silica gel treated with cadmium chloride. The length of the cadmium sulphide spot, which was determined by fluorescence excited by radiation at a wavelength of 300 nm, was found to be linear in the hydrogen sulphide concentration in the air over the concentration range 0.2–1.3 ppm. Cardoso et al. (71) have developed a detector for atmospheric hydrogen sulphide using the quenching of the fluorescence of alkaline fluorescein mercuric acetate. The hydrogen sulphide reacted with the fluorescein mercuric acetate solution on a small drop attached to an optical fibre, which excited the solution at a wavelength of 495 nm; a small silicon photodiode was used to measure the fluorescence at a wavelength of 530 nm. The maximum volume of the liquid drop was 60 $\mu$l and controlled detachment of the drop enabled a new sensing surface to be exposed to the hydrogen sulphide. The fluorescence detector was capable of detecting hydrogen sulphide in flowing air samples at concentrations of 30 ppb (by volume) with response times of less than 4 minutes. Choi(72) has described the fabrication of a reversible fluorescence sulphide ion sensor for aqueous solutions based on the fluorescence quenching of tetraoctylammonium fluorescein mercuric acetate. The tetraoctylammonium fluorescein mercuric acetate indicator was immobilised in an ethyl cellulose membrane formed on a transparent plastic sheet and located on the wall of a glass flow cell. The fluorescence spectra had a peak intensity at 536 nm and the fluorescence was observed to respond to hydrosulphide ions ($HS^-$) over the concentration range $0.012–120\times10^{-6}$ mole/L (0.4 ppb-4 ppm) for aqueous solutions in the pH range 9.0–12.5. The tetraoctylammonium fluorescein mercuric acetate fluorescence sensor could be regenerated by rinsing with a solution containing sodium acetate and sodium hypochlorite.

Lessard and Ramesh(73) have described a method of measuring the concentration of hydrogen sulphide (or sulphide ions) by reaction with scavenging reagents whose fluorescence properties are subsequently changed. Non-fluorescent amines with the general structure R—NH—$CH_2$—NH—R', where R and R' are groups which contain electronically-active units, react with hydrogen sulphide (or sulphide ions) to form molecules of the form R—NH—$CH_2$—S—S—$CH_2$—NH—R' which are fluorescent. For example, the amine 6-aminoquinoline was reacted with formaldehyde to generate a non-fluorescent diamine that reacted quantitatively with hydrogen sulphide to form a fluorescent disulphide. Both water- and oil-soluble diamines have been synthesised; for example, a water-soluble sulphide scavenger was synthesised by coupling two molecules of morpholine with formaldehyde. Lessard and Ramesh(73) showed that some maleimides can be made fluorescent by reaction with hydrogen sulphide or sulphide ions. For example, N—(1-pyrene)maleimide is not fluorescent but its reaction product with hydrogen sulphide is fluorescent. Lessard and Ramesh also demonstrated that some diamines exhibit fluorescence that is quenched by reaction with hydrogen sulphide. For example, the amine 6-aminocoumarin can be coupled using formaldehyde to form a fluorescent diamine; reaction with hydrogen sulphide forms a disulphide, which exhibits no fluorescence.

McCulloch et al.(74) described in some detail the use of optical waveguide sensors to measure the concentration of hydrogen sulphide. Novel waveguide sensors for hydrogen sulphide were developed using both optical absorption and Raman scattering detection techniques. A sol-gel coating technique was used to deposit ferrocene, in the form of the ferricenium cation $[(C_5H_5)_2Fe(III)]^+$, on an exposed portion of optical fibre. The ferricenium cation was reduced in the presence of hydrogen sulphide and its colour changed from blue-green to orange. The colour change was monitored at a wavelength of 620 nm. The ferrocene was oxidised back to the initial ferricenium complex by exposure to air or oxygen. Surface-enhanced resonance Raman spectroscopy was used to detect the presence of hydrogen sulphide using methylene blue adsorbed on a film of silver deposited on an optical fibre in the presence of ammonium molybdate. A recent patent application(75) has described the use of optical fibre sensors to measure the concentration of a number of chemical components in drilling fluids, including hydrogen sulphide, in the downhole environment while drilling. The sensing element attached to the optical fibre was described as a suitable colorimetric indicator immobilised in a porous glass matrix generated by a sol-gel process. A specific calorimetric indicator for the measurement of the concentration of hydrogen sulphide was not disclosed.

The application of equilibrium headspace analysis to the quantitative determination of gases in solution is a well-known technique, particularly for gas chromatography (76–78). Vitenberg et al.(79) and Brunner et al.(80) have described the quantitative analysis of hydrogen sulphide in aqueous media by headspace gas chromatography. Ramstad et al.(81) have used headspace gas chromatography to detect the evolution of hydrogen sulphide from dry powder samples. Kolb and Ettre(82) have explained a procedure for the analysis of the hydrogen sulphide content of crude oil by headspace gas chromatography. The use of the equilibrium headspace technique with specific gas sensors to determine the gas content of liquid samples does not appear to have been reported in the open literature.

The determination of the bubble point of liquid hydrocarbon samples and their gas content in a wellbore under reservoir conditions using a wireline tool has been described in two separate patents(83,84). Schultz and Bohan(83) have described in some detail the design of a wireline tool that captures a sample of liquid hydrocarbon with the purpose of expanding it to produce gas. The measured pressure-volume relationship obtained during the expansion allows the compressibility and the bubble point of the liquid hydrocarbon to be determined; the bubble point is readily determined from the rapid change of slope in the pressure-volume curve. A more recent patent has been assigned to Yesudas et al.(84) who described a pressure-volume technique for determining the compressibility and the bubble point of samples of liquid hydrocarbons captured by a wireline (or similar) sampling tool. The volume of gas dissolved in the sample could also be measured to determine the gas-oil ratio (GOR). Neither of these two patents gives any description of any technique to measure the concentration of any liquid hydrocarbon or exsolved gas samples. In addition, neither patent gives any description of measurements of the gas content of captured water samples.

Kurosawa et al.(85) have described the construction of a biosensor for the determination of the hydrogen sulphide content of aqueous samples. The sensor consisted of cells of the bacterium *Thiobacillus thiooxidans* immobilised in a porous filter in an oxygen electrode. The bacterium oxidised hydrogen sulphide in aqueous solution and decreased the oxygen content that was detected by the oxygen electrode. Concentrations of hydrogen sulphide in water of $5\times10^{-5}$ molar (1.7 ppm) were detected with a response time of about 5 minutes.

There appear to be no reports in the public domain which describe the measurement of the concentration of hydrogen sulphide, or any other chemical species, in samples of hydrocarbon or water captured by a wireline sampling tool using any specific chemical sensor or detector system. Mariani and Mullins(86) have discussed the use of microwave (molecular rotation) spectroscopy to measure the concentration of hydrogen sulphide extracted as a gas from sub-surface fluid samples. The design of a downhole microwave spectrometer, operating the frequency range 150–400 GHz, was outlined, including the use of a Fabry-Perot interferometer to replace a long path length gas cell. Mariani and Mullins discussed the measurement of hydrogen sulphide in a wireline fluid sampling tool and a measurement while drilling technique. The United Kingdom Patent No. 2344365 B described a method of extracting the hydrogen sulphide from hydrocarbon samples using a packed bed of a metal oxide and discussed the possibility of monitoring the changes in the electrical conductivity of the metal oxide to measure the concentration of removed hydrogen sulphide. Hager(57) has described methods for sampling hydrocarbons and other chemical species from the drilling fluid during the drilling process using a sampling tool close to the bit; hydrogen sulphide was not specifically identified as a chemical species. A recent patent application by Weirich et al.(75) has described the application of an optical fibre-based sensor to measure the concentration of hydrogen sulphide in drilling fluid close to the bit during drilling. This patent application appears to be the only prior art for any measurement of hydrogen sulphide in the wellbore environment.

SUMMARY OF THE INVENTION

In accordance with the present invention, there are provided methods and apparatus to measure, preferably in situ, the concentration of hydrogen sulphide in fluid samples captured by a downhole wireline fluid sampling tool. The assignee of this application has provided a commercially successful borehole tool, the MDT (a trademark of Schlumberger) which extracts and analyzes a flow stream of fluid from a formation in a manner substantially set forth in co-owned U.S. Pat. No. 3,859,851 to Urbanosky U.S. Pat. No. 3,780,575 to Urbanosky and U.S. Pat. No. 4,994,671 to Safinya et al.

Based on the MDT (Trademark of Schlumberger) or similar tools, it is a first general aspect of the invention, to provide a system comprising an aperture or opening to a conduit allowing formation fluid to pass from a location within the formation into the body of the downhole tool and a system and method for extracting from the formation fluid hydrogen sulphide and sensing the presence or amount of hydrogen sulphide either directly of after letting the hydrogen sulphide react to generate a detectable composition. The extracted hydrogen sulphide (or any reaction products thereof) is preferably in a fluid state, i.e. in a non-solid state, thus facilitating an in-situ detection. The hydrogen sulphide is extracted or separated from the formation fluid by migration into a volume or space inaccessible by the formation fluid. The volume or space can be filled with suitable reactants or a matrix material through which hydrogen sulphide can diffuse.

Preferably two types of measurement technique are used to extract hydrogen sulphide in a fluid state from the formation fluid. The first technique is based on a headspace measurement of hydrogen sulphide in the gas phase above the liquid sample, which is formed by reducing its hydrostatic pressure. The concentration of hydrogen sulphide in the original liquid hydrocarbon sample can be calculated from the measured gas phase concentration and knowledge of the Henry's law constant for the hydrocarbon. This measurement method can also be applied to the hydrogen sulphide content of formation water samples if the pH of the sample is either measured or fixed by a suitable buffer.

The second preferred measurement technique is based on the measurement of the flux of hydrogen sulphide across a gas extraction membrane in contact with a flowing sample of reservoir fluid. Several methods are described to measure the flux of hydrogen sulphide across the extraction membrane. The first method uses a redox cell that oxidises the hydrogen sulphide by converting ferricyanide to ferrocyanide ions and the measured redox current is directly proportional to the concentration of hydrogen sulphide in the reservoir fluid. The second method measures the methylene blue formed in an optical absorption cell by the reaction of the hydrogen sulphide diffused across the membrane with iron(III) ions and N,N-dimethyl-p-phenylenediamine in an acidic aqueous solution; the methylene formed is detected spectrophotometrically at a wavelength of 660 nm. The rate of change of absorbance at 660 nm is directly proportional to the concentration of hydrogen sulphide in the reservoir fluid sample.

Another embodiment of the membrane-based extraction employs a membrane-covered or membrane-coated sensor, e.g., a lead acetate (PbAc)tape. Hydrogen sulphide diffuses into and through the body of the membrane material. The membrane material provides the volume necessary to physically separate hydrogen sulphide from the formation fluid. In other words, the body of the membrane acts as the extraction chamber. The PbAC tape changes color in response to being exposed to hydrogen sulphide. This change can be interrogated by an optical detector system. In a particular preferred embodiment of this variant, the tape is kept in a sealed chamber held at ambient pressure through a moveable piston. The dynamic range of the measurement can be further improved by using a membrane of non-uniform thickness.

It is seen as a particular feature of the present invention that the hydrogen sulphide sensor can be renewed or reactivated while the downhole tool remains within the borehole. In other words, a sensor or sensing surface gradually loosing its sensitivity is replaced while the tool remains in the wellbore.

These and other features of the invention, preferred embodiments and variants thereof, possible applications and advantages will become appreciated and understood by those skilled in the art from the following detailed description and drawings.

DRAWINGS

MODE(S) FOR CARRYING OUT THE INVENTION

Two methods are described to determine the concentration of hydrogen sulphide in liquid and gas samples captured by a wireline fluid sampling tool.

(i) Equilibrium Headspace Gas Analysis

Figure 1:
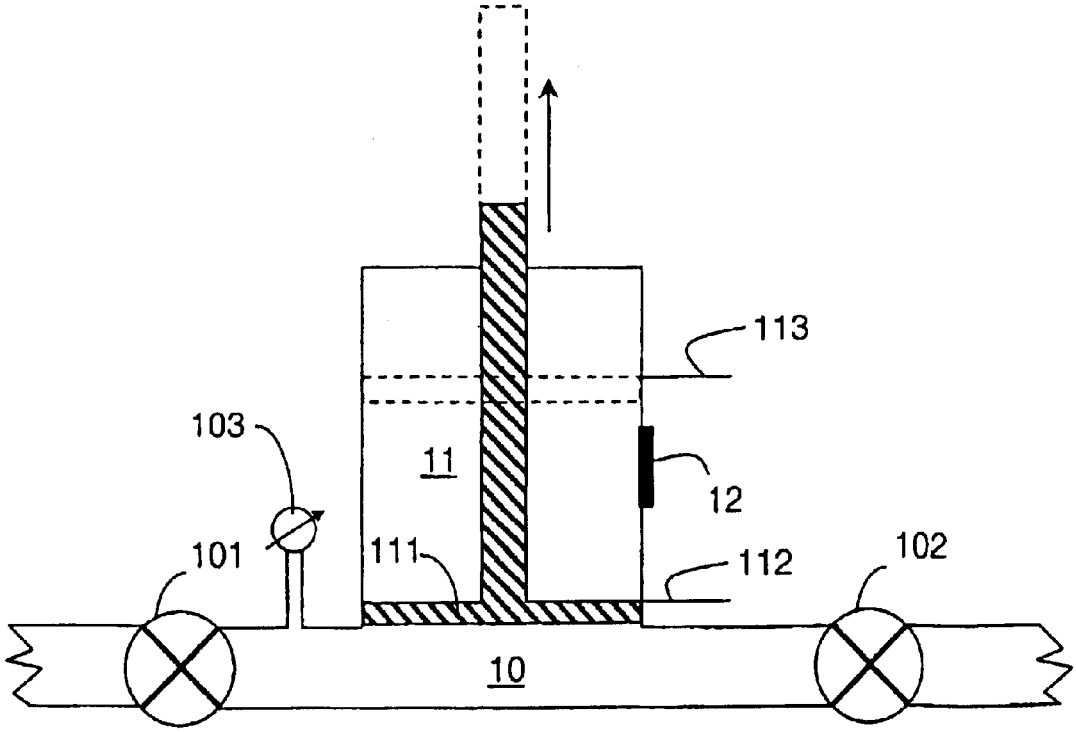
FIG. 1 is a schematic diagram of a fluid sample chamber for the measurement of the hydrogen sulphide concentration in a headspace above the sample.

FIG. 1 shows a schematic of a part of the sample flow line 10 of a wireline formation sampling tool. This portion of the fluid sample flow line can be hydraulically isolated from the remainder of the tool's flow lines by means of valves 101 and 102. The sealable portion of the flow line is connected to a chamber 11, which contains a piston 111 that may be retracted into the chamber in a controlled manner. The initial location of the piston is 112 where the face of the piston is flush with the wall of the sample flow line 10. The hydrostatic pressure $P_H$ of the fluid sample in the sealed flow line can be measured by the pressure transducer 103. The volume of fluid sealed between valves 101 and 102 is denoted $V_I$ while the expansion volume of the chamber 11 is denoted $V_C$. The total volume of the fluid sample is denoted $V_T(=V_I+V_C)$. When $V_T=V_I$, the initial volume of the liquid hydrocarbon sample, the hydrostatic pressure $P_H$ is equal to the reservoir pressure $P_R$. Retraction of piston 111 to the level 113 causes the volume $V_C$ (and hence $V_T$) to increase and the fluid pressure $P_H$ decreases below its initial value of $P_R$.

Figure 2:
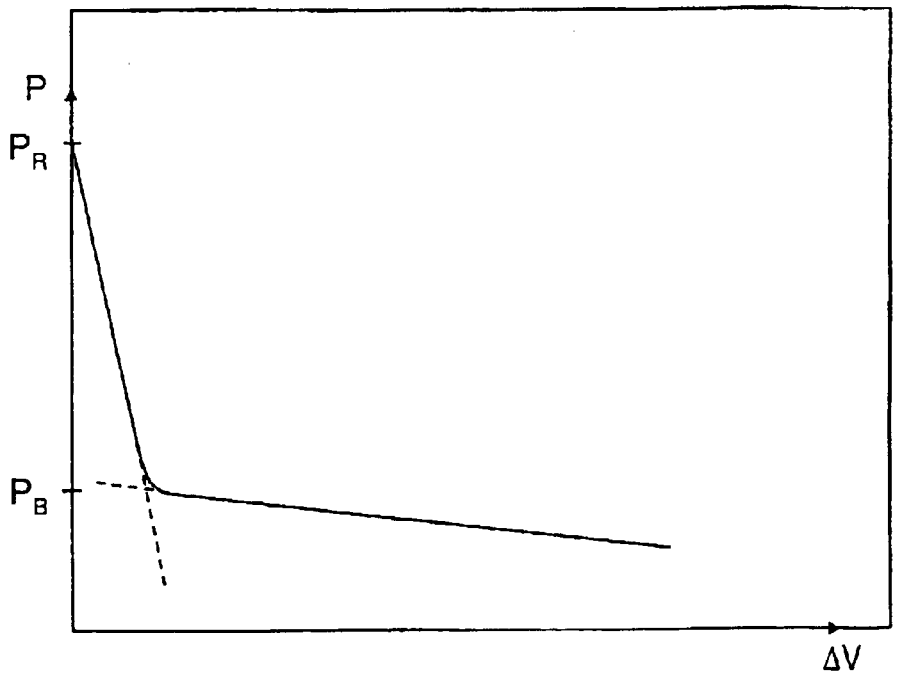
FIG. 2 illustrates the pressure-volume behaviour of a typical liquid hydrocarbon.

FIG. 2 shows the variation of $P_H$ with $V_C$ for a typical liquid hydrocarbon. The pressure $P_H$ of the liquid decreases rapidly and the relationship between $P_H$ and $V_T$ is described by $$dP_H = -\frac{1}{\beta V_T} dV_T \quad [1]$$

where β is the isothermal compressibility of the liquid hydrocarbon. For a finite change in $V_T$ from $V_I$ to some liquid volume $V_L$ at pressure $P_H=P_L$, eqn. [1] can be integrated, assuming β is constant, to give $$\beta(P_R - P_L) = \ln\left(\frac{V_L}{V_I}\right) \quad [2]$$

from which the compressibility of the liquid hydrocarbon is readily determined.

At some hydrostatic pressure $P_H=P_B$, gases in solution in the liquid hydrocarbon form a separate gas phase. The characteristic pressure $P_B$ is termed the bubble pressure and is an important parameter in the phase behaviour of liquid hydrocarbons (see, for example, ref. 87). A further increase in $V_C$ causes the gases to come out of solution and expand in the gas phase. It is evident from FIG. 2 that the compressibility of the liquid-gas mixture is considerable greater than that of the original liquid hydrocarbon sample. When the condition $P_H<P_B$ holds, the compressibility of the hydrocarbon sample is dominated by the compressibility of the exsolved gas.

The piston is retracted to position 113 where it exposes the hydrogen sulphide gas sensor to the gaseous headspace formed above the liquid hydrocarbon. The gas sensor 12 can be one of a number of suitable detectors, preferably a detector that does not require a regeneration step to be reusable. For example, a conventional hydrogen sulphide metal oxide gas detector requires oxygen (usually from an air stream) to regenerate its surface for continued use. Gas sensors that make use of a renewable sensing element are therefore particularly attractive. One example of a renewable gas sensor element is the surface of a liquid containing a reagent whose optical properties are modified on contact with hydrogen sulphide gas. The liquid can take the form of a drop attached to an optical fibre that measures the change in the intensity of the fluorescence of the liquid after some given time. Soluble cadmium compounds can be used to generate fluorescent cadmium sulphide particles on contact with hydrogen sulphide. Alternatively, the drop can contain a reagent, such as alkaline fluorescein mercuric acetate, whose fluorescence is decreased on contact with hydrogen sulphide gas. The liquid sensing surface can be renewed for each measurement by forcing the liquid drop to detach. Alternatively, a solid surface can be used as a renewable detector by depositing cadmium salts on a moveable polymer strip; the cadmium sulphide formed in contact with hydrogen sulphide can be detected by fluorescence.

The gas sensor may be protected from direct contact with any liquid phase by the use of a suitable membrane, such as the porous membranes made of polytetrafluoroethylene (PTFE)(45) or non-porous membranes such as those made of silicone rubber(68). The gas sensor can be protected from contact with liquid phases when sampling in deviated and horizontal wells by allowing its orientation to be controlled with respect to the location of the liquid-gas interface in the chamber 11 (FIG. 1). The sensor can be positioned in the gas phase by rotation of the chamber, using, for example, a stepper motor controlled by the operator of the sampling tool. Alternatively, a plurality of sensors may be employed mounted on a carrousel that, after each step, rotates a new sensor into the chamber.

Alternatively, the hydrogen sulphide detector 12 can be an electrochemical gas sensor similar to that described by Jeroschewski and coworkers(45). The sulphide redox cell, which consists of an alkaline solution of potassium ferricyanide and two platinum electrodes, is located behind a gas permeable membrane such as PTFE or an inert porous membrane saturated with suitable fluorinated compound (e.g., fluorinated polyether) in which the gas has high solubility. Parrillo et al.(88) have described a novel gas separation membrane, termed a selective surface flow membrane, which was able to separate hydrogen sulphide from less polar molecules such as hydrogen. The membrane consisted of a thin nanoporous carbon coating on an inert alumina support; the polar hydrogen sulphide molecules selectively adsorb on the walls of the carbon pore and diffuse on the surface through to the porous substrate where they can be reacted and detected.

The liquid hydrocarbon sample contains $m_o$ grams of hydrogen sulphide in the initial volume $V_I$ at the initial pressure $P_R$. At the bubble pressure $P_B$ the volume of the liquid hydrocarbon sample has increased to $V_B$, which is related to $P_B$ (from eqn. [2]) by $$\beta(P_R - P_B) = \ln\left(\frac{V_B}{V_I}\right). \quad [3]$$

When the hydrostatic pressure of the liquid sample falls below $P_B$ the gas in the sample comes out of solution and the hydrogen sulphide is partitioned between the two phases. The number of moles of hydrogen sulphide in the initial liquid phase is $n_o(=m_o/M_w$, where $M_w$ is the molecular weight of hydrogen sulphide, 0.034 kg/mole, and $m_o$ is the weight of hydrogen sulphide in kg), which partitions into $n_L$ moles in the liquid phase and $n_G$ moles in the gas phase.

It is assumed that the hydrogen sulphide and other exsolved gases behave ideally and that Henry's law can describe the solubility of hydrogen sulphide in the liquid hydrocarbon sample. In the gas phase $$n_G = \frac{P_i V_G}{RT} \quad [4]$$

where $P_i$ is the partial pressure of hydrogen sulphide in the exsolved gases, $V_G$ is the gas volume, T is the absolute temperature of the gas mixture and R is the gas constant (8.3143 J/K/mole). The measured concentration $C_G$ of hydrogen sulphide in the exsolved gases, obtained directly from the headspace gas detector, is related to the partial pressure of hydrogen sulphide by $$C_G = \frac{n_G M_W}{V_G} = \frac{P_i M_W}{RT} \quad [5]$$

The mole fraction $X_L$ of hydrogen sulphide in the liquid hydrocarbon is related to $P_i$ by Henry's law, which can be stated as $$X_L = \frac{P_i}{H} \quad [6]$$

where H is the Henry's law constant and $X_L$ is defined as $$X_L = \frac{n_L}{n_L + n_S} \quad [7]$$

where $n_L$ and $n_S$ are the number of moles of hydrogen sulphide and solvent (and any other solutes), respectively. In the dilute solution limit of Henry's law, $n_L << n_S$, whereupon $$X_L = \frac{n_L}{n_S} = \frac{n_L M_S}{\rho_S V_L} \quad [8]$$

and $\rho_S$ is the density of the liquid hydrocarbon and $M_S$ is its molar mass. Henry' law can be expressed in the form $$n_L = \frac{P_i \rho_S V_L}{HM_S} = \frac{C_G RT \rho_S V_L}{HM_S M_w} \quad [9]$$

and the total number of moles of hydrogen sulphide in the original liquid hydrocarbon sample can be expressed as $$n_o = n_L + n_G = \frac{C_G RT \rho_S V_L}{HM_S M_w} + \frac{V_G C_G}{M_w} \quad [10]$$

or $$n_o = \frac{C_G}{M_w}\left[\frac{RT\rho_S V_L}{HM_S} + V_G\right]. \quad [11]$$

The concentration $C_o$ of hydrogen sulphide in the original liquid hydrocarbon sample is therefore $$C_o = \frac{n_o M_w}{V_l} = \frac{C_G}{V_l}\left[\frac{RT\rho_S V_L}{HM_S} + V_G\right], \quad [12]$$

which can be obtained from the measured value of $C_G$, the known values of $V_G$ and $V_L$ and the values of the Henry's law constant for hydrogen sulphide in the liquid hydrocarbon sample and the density and average molar mass of the hydrocarbon. The values of $V_G$ and $V_L$ can be measured directly using a suitable level indicator in chamber 11. Alternatively, the value of $V_L$ can be obtained to a good approximation by assuming that for $P<P_B$changes in $V_T$ are dominated by changes in $V_G$ and thus $V_L \approx V_B$ and $V_G \approx V_T - V_B$. In the above treatment, the liquid hydrocarbon can be approximated by a suitable alkane solvent of known density and molar mass for which values of the Henry's law constant are available over the temperature range 25–225° C.(89–92). Alternatively, the Henry's law constant may be known for the particular hydrocarbon that is being sampled.

The determination of the concentration of hydrogen sulphide in the original liquid hydrocarbon sample by a headspace gas analysis is not critically dependent on the value of the Henry's law constant for the hydrocarbon. For the above treatment, the hydrocarbon properties are described by the term $\rho_S/HM_S$, which varies relatively little over a wide range of hydrocarbon types for a given temperature. For example, Table 1 compares the values of the term $\rho_S/HM_S$ for 8 hydrocarbons at 100° C. The numerical value of the term is in the narrow range 0.5–1.0 over a wide range of hydrocarbon composition. Note that the value of $\rho_S/HM_S$ for hexadecane using values of H from two different sources(89,91) differ by more than 0.1 $MPa^{-1}L^{-1}$.

TABLE 1

Comparison of the values of $\rho_S/HM_S$ for a range of liquid hydrocarbons at 100° C.

| Solvent | H (MPa) | $\rho_S$ (g/L) | $M_S$ (g/mole) | $\rho_S/HM_S$ ($MPa^{-1}L^{-1}$) |
|---|---|---|---|---|
| iso-octane | 6.73[a] | 692 | 114.23 | 0.900 |
| decane | 6.38[a] | 730 | 142.29 | 0.804 |
| tridecane | 4.92[a] | 756 | 184.37 | 0.833 |
| hexadecane | 4.30[a] | 778 | 226.45 | 0.799 |
| squalene | 2.86[a] | 858 | 410.73 | 0.730 |
| hexadecane | 5.04[b] | 778 | 226.45 | 0.682 |
| diphenyl-methane | 7.10[b] | 1006 | 168.24 | 0.842 |
| dicyclohexyl | 9.29[b] | 864 | 166.31 | 0.560 |
| 1-methyl naphthalene | 7.33[b] | 1001 | 143.20 | 0.954 |

[a]Data from ref. 89 (T = 100° C.)
[b]Data from ref. 91 (T = 101.8° C.)

The use of a headspace gas detector to determine the concentration of hydrogen sulphide in the original liquid hydrocarbon sample at its original (reservoir) pressure can be illustrated by the following example. A sample of liquid hydrocarbon was taken from a sandstone formation at a temperature of 123° C. (396.2 K.) and a hydrostatic pressure of 4200 psi (285 bar). The volume of liquid hydrocarbon sample used for the headspace analysis was $V_I$=50 ml ($5\times10^{-5}$ $m^3$). This sample of hydrocarbon was carefully expanded until the bubble pressure was reached at $P_B$=2915 psi (198 bar) and the liquid volume had expanded to $V_L$=50.65 ml ($5.07\times10^{-5}$ $m^3$). The pressure in the chamber was further decreased until the volume $V_T$=131.15 ml and $V_G$=80.50 ml ($8.05\times10^{-5}$ $m^3$). A constant reading from the exposed gas detector was used to determine the establishment of equilibrium between the hydrogen sulphide in the headspace and the liquid hydrocarbon. The equilibrium hydrogen sulphide content of the headspace was measured to be 105 ppm (1.05—$10^{-4}$ g/l). The liquid hydrocarbon sample was approximated by the normal alkane hexadecane ($C_{16}H_{34}$) for which $\rho_S$=773 kg/$m^3$, $M_S$=0.226 kg/mole and the data of Yokoyama et al.(91) gave an interpolated Henry's law constant of H=6.4 MPa ($\rho_S/HM_S$=0.53 $MPa^{-1}L^{-1}$). Substitution of these values into eqn. [12] gives a value of $C_o$ of 362 ppm ($3.62\times10^{-4}$ g/l). If, however, the hydrocarbon sample was approximated by a liquid with an upper value of $\rho_S/HM_S$ of 1.00 $MPa^{-1}L^{-1}$, then the value of $C_o$ would be 527 ppm for the same sampling conditions.

The headspace method can also be used to determine the hydrogen sulphide content of gas and formation water samples. The hydrogen sulphide content of gas samples can be measured at a value of $P_H$, determined by the choice of $V_C$, to ensure the gas sensor operates at its optimum sensitivity. The measured concentration of hydrogen sulphide $C_G$ at gas volume $V_T$ is related to the initial concentration by $$C_I = C_G\left(\frac{V_T}{V_I}\right) \quad [13]$$

The measurement of the hydrogen sulphide concentration in the headspace above a water sample is complicated by its dissociation in aqueous media:

$$H_2S \leftrightarrows HS^- + H^+ \quad [14]$$

$$HS^- \leftrightarrows S^{2-} + H^+ \quad [15]$$

The equilibrium constant $K_1$ for the first dissociation of hydrogen sulphide is $$K_1 = \frac{C_{HS}C_H}{C_L} \quad [16]$$

where $C_{HS}$ and $C_H$ are the concentrations of $HS^-$ and $H^+$ ions, respectively, in the water sample and $C_L$ is the concentration of molecular hydrogen sulphide. The equilibrium constant $K_1$ has a value of $3.9\times10^{-8}$ moles/L at 0° C., $9\times10^{-8}$ moles/L at 25° C. and $3\times10^{-7}$ moles/L at 100° C.(93). The second dissociation of hydrogen sulphide to give $S^{2-}$ ions has an estimated equilibrium constant $K_2$ of $10^{-19}$ moles/L (94) and can be entirely neglected for the headspace analysis of formation water samples. Since any loss of hydrogen sulphide gas from the aqueous solution (e.g., by sample decompression) will result in $HS^-$ and $H^+$ ions forming $H_2S$, the total effective concentration of hydrogen sulphide in solution is $$C_T = C_o + C_{HS} \quad [17]$$

where, from eqn. [16], $C_{HS}$ is given by $$C_{HS} = \frac{K_1 C_L}{C_H} = \frac{K_1 C_1}{10^{-pH}} \quad [18]$$

noting that $pH = -\log_{10}C_H$ and $C_L$ is the concentration of hydrogen sulphide in the water sample under the conditions of the headspace gas measurement. The total hydrogen sulphide concentration $C_T$ in the original water sample is $$C_T = C_o + \frac{C_L K_1 V_L}{V_I 10^{-pH}} \quad [19]$$

where $C_o$ is given by eqn. [12] and $C_L$ is given by $$C_L = \frac{C_G R T \rho_S V_L}{H M_S V_I}. \quad [20]$$

The Henry's law constant for the solubility of hydrogen sulphide in water over a wide range of temperatures is readily available(93,95). For example, Carroll and Mather (93) have expressed the temperature dependence of H over the temperature range 0–90° C. by $$\ln H = -3.3747 + 0.072437T - 1.10765\times10^{-4}T^2 - -\frac{1549.159}{T} + 0.144237\ln T \quad [21]$$

for H in MPa and T in Kelvin. At a temperature of 90° C. eqn. [21] gives H=135 MPa and the value of the term $\rho_S/HM_S$ is 0.41. The Henry's law constant for hydrogen sulphide in water is considerably larger than the value of H for liquid hydrocarbons and the solubility of hydrogen sulphide in water is therefore correspondingly lower. The presence of salts, such as sodium chloride, in formation waters increases the value of H and makes hydrogen sulphide less soluble. Suleimenov and Krupp(95) have measured values of H for hydrogen sulphide in sodium chloride solutions over the concentration range 0–3 molar and over the temperature range 0–365° C. The difference in the values of H over this range of sodium chloride concentration and over the temperature range 0–200° C. is 10% or less.

For many practical applications, the concentration of HS ions in the water sample can be considered-to be negligible because the dissociation of hydrogen sulphide itself determines the pH. For example, at a temperature of 90° C. and a partial pressure in the headspace of 1 bar (0.1 MPa), the mole fraction of hydrogen sulphide in water is approximately $5\times10^{-4}$(93), which translates to a concentration of 0.028 moles/L (950 ppm). Eqn. [16] predicts a concentration of $HS^-$ ions of $9\times10^{-5}$ moles/L (3 ppm) and a pH of 4.0. If the partial pressure of the hydrogen sulphide in the headspace is decreased such that its solubility decreases to 30 ppm, then the concentration of $HS^-$ decreases to 0.5 ppm and the pH is 4.8.

The concentration of $HS^-$ ions rises dramatically it the pH of formation water samples is raised by the presence of other dissolved species such as carbonate ions. For example, if the pH of the water sample containing 950 ppm of hydrogen sulphide at 90° C. is 7.0, then eqn. [16] predicts the concentration of $HS^-$ ions to be 2770 ppm. The concentration of $HS^-$ ions is only negligible in comparison to the concentration of dissolved hydrogen sulphide gas if the pH is below 5.

A reliable measurement of the concentration of hydrogen sulphide in formation water samples therefore requires the pH of the sample to be either measured or fixed. The measurement of the pH of the formation water sample at elevated temperatures and pressures can be achieved by a suitable electrochemical or optical sensor. For example, Shorthouse and Peat(96) have described an electrochemical sensor to measure the pH of water samples up to a temperature of 120° C. and a pressure of 1000 bars. An alternative method is to mix the formation water sample with a suitable pH buffer in the sample chamber to decrease the solution pH to below 5. One possible buffer is an aqueous solution of potassium hydrogenphthalate (0.01 moles/L), which has a pH of 4.01 at 25° C. and a value of 4.23 at 95° C.(97).

(ii) Membrane Permeation Gas Analysis

Figure 3:
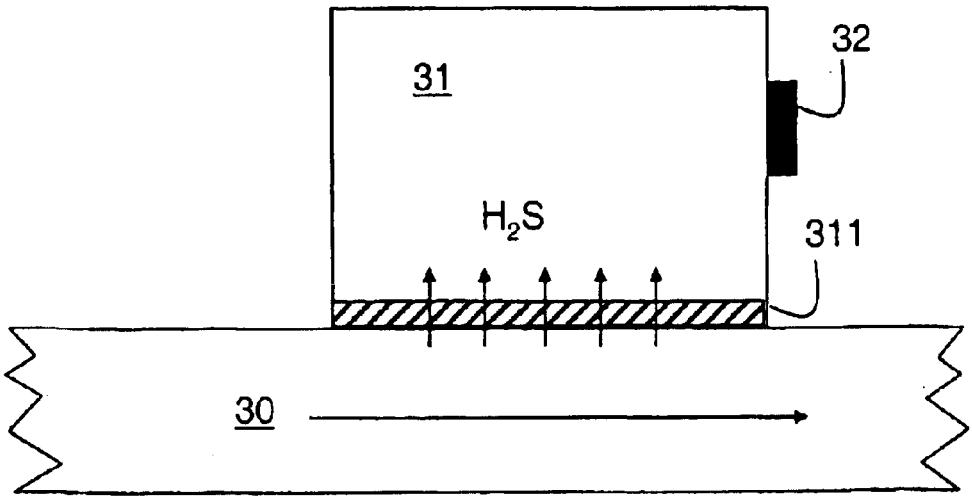
FIG. 3 is a schematic diagram of a hydrogen sulphide sensor using a gas separation membrane to extract hydrogen sulphide from a flowing stream of a wellbore fluid.

The basis of the second method is the extraction of hydrogen sulphide directly from the liquid sample into an analysis chamber using a suitable gas stripping membrane. FIG. 3 shows a schematic of a flow channel 30 in a sampling tool and an analysis chamber 31 separated by a thin extraction membrane 311. The hydrogen sulphide is extracted into the analysis chamber at a rate that depends on its diffusion coefficient in the membrane 311 and the concentration gradient. The flux J of hydrogen sulphide across the membrane is given by Fick's law $$J = -D\frac{dC}{dx} \quad [22]$$

where D is the diffusion coefficient of hydrogen sulphide in the membrane and dC/dx is the concentration gradient across the membrane. The concentration of hydrogen sulphide in the analysis chamber is zero as it reacts immediately to form a new sulphur-containing species, while the concentration in the flowing fluid sample is taken to be a constant value $C_L$. If the thickness of the membrane 311 is L, then eqn. [22] becomes $$J = \frac{DC_L}{L} \quad [23]$$

noting that the flux J is in units of mass per unit area per unit time. The rate of transport of hydrogen sulphide across the membrane can be expressed in terms of moles per unit time $$J' = \frac{dn}{dt} = \frac{DC_L S_m}{M_w L} \quad [24]$$

where $S_m$ is the surface area of the membrane exposed to the reservoir fluid.

One of several membranes can be envisaged to extract hydrogen sulphide from the reservoir fluid. For example, a porous membrane containing a perfluoropolyether in which the hydrogen sulphide is soluble would allow separation from both water arid liquid hydrocarbons. Non-porous membranes, such as polytetrafluoroethylene (PTFE) and silicone-based polymers, have been used to separate hydrogen sulphide from mixtures. For example, Neihof(68) has described the use of various crosslinked silicone polymers, including polydimethyl silicone and fluorosilicone polymers. Facilitated transport membranes can be constructed containing functional, groups, such as polyvinylbenzyltrimethylammonium fluoride(98), which complex reversibly with hydrogen sulphide and allow it to be selectively transported to the analysis chamber 31.

(a) Electrochemical Sensor

The chemical sensor 32 in the analysis chamber 31 measures the rate of transport through the membrane. In the following, two chemical sensor systems are described to measure the rate of accumulation of hydrogen sulphide.

Figure 4:
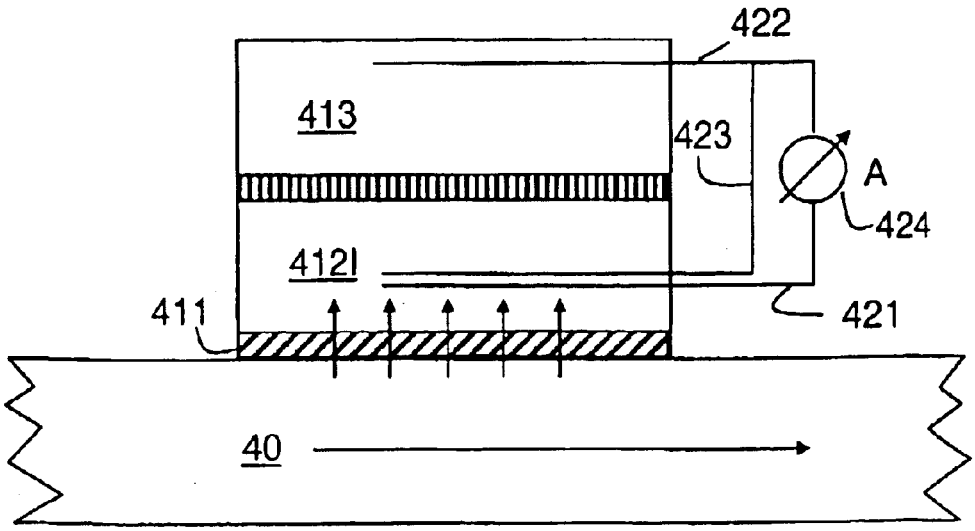
FIG. 4 is a schematic diagram of an amperometric sensor to measure the concentration of hydrogen sulphide in a flowing sample of a wellbore fluid.

The first sensor, as shown in FIG. 4 is based on a Clark-type amperometric sensor described by Jeroschewski and coworkers(45). FIG. 4 shows a schematic of the amperometric sensor, together with the membrane 411 through which the hydrogen sulphide is extracted from the flowing wellbore fluid sample 40. The redox cell consists of two chambers 412, 413 containing alkaline solutions of potassium ferrocyanide ($K_3[Fe(CN)_6]$) of different concentrations separated by a cation exchange membrane 414. The two chambers 412, 413 are connected electrically by platinum electrodes 421, 422, the working and counter electrodes, via an ammeter 424. A third electrode 423, a guard electrode, can be used and connected to counter electrode 422 to prevent the diffusion of any electroactive species towards the working electrode 421.

The hydrogen sulphide extracted from the wellbore fluid by the membrane 411 is converted to hydrosulphide ions (eqn. [14]) which are oxidised by the ferricyanide ions to form elemental sulphur:

$$HS^- + 2[Fe(CN)_6]^{3-} + H_2O \rightarrow S + 2[Fe(CN)_6]^{4-} + H_3O^+ \quad [25]$$

The ferrocyanide ions produced by the reduction of $HS^-$ are immediately oxidised back to ferricyanide ions $$2[Fe(CN)_6]^{4-} \rightarrow 2[Fe(CN)_6]^{3-} + 2e^- \quad [26]$$

and the electrons reduce the ferricyanide in the counter electrode chamber 413. The redox current $I_R$ is the rate of flow of charge, which is given by $$I_R = \frac{dq}{dt} = 2F\frac{dn}{dt} \quad [27]$$

where F is Faraday's constant (96,500 Coulombs/mole). The combination of eqns. [24] and [27] yields $$C_L = \frac{M_w L I_R}{2FDS_m} \quad [28]$$

The concentration $C_L$ of hydrogen sulphide in the borehole fluid sample is proportional to the measured redox current $I_R$ if the diffusion coefficient D of the hydrogen sulphide in the membrane 411 is also a constant. For example, a silicone polymer membrane of thickness L=100 $\mu$m and contact area $S_m$=8 $cm^2$ was used to extract hydrogen sulphide from a flowing liquid hydrocarbon sample into the redox cell. The diffusion constant of hydrogen sulphide in the silicone polymer membrane formed from dimethylsiloxane was $D=8.4\times10^{-9}$ $m^2/s$ (99) and the measured redox current $I_R$=95 $\mu$A. From eqn. [28] the concentration $C_L=2.5\times10^{-4}$ $kg/m^3$ or 250 ppm. Note that the flux of hydrogen sulphide across the silicone polymer membrane was $1.7\times10^{-11}$ kg/s.

The membrane permeation electrochemical cell can also be used to determine the hydrogen sulphide concentration in water samples. However, gas permeation membranes made of materials such as silicone polymers are not permeable to sulphide ions ($HS^-$, $S^{2-}$) and therefore only the concentration of molecular hydrogen sulphide will be measured. The concentration of sulphide ions can be determined from the measured concentration of hydrogen sulphide if the pH of the water sample is known.

(b) Optical Sensor

Figure 5:
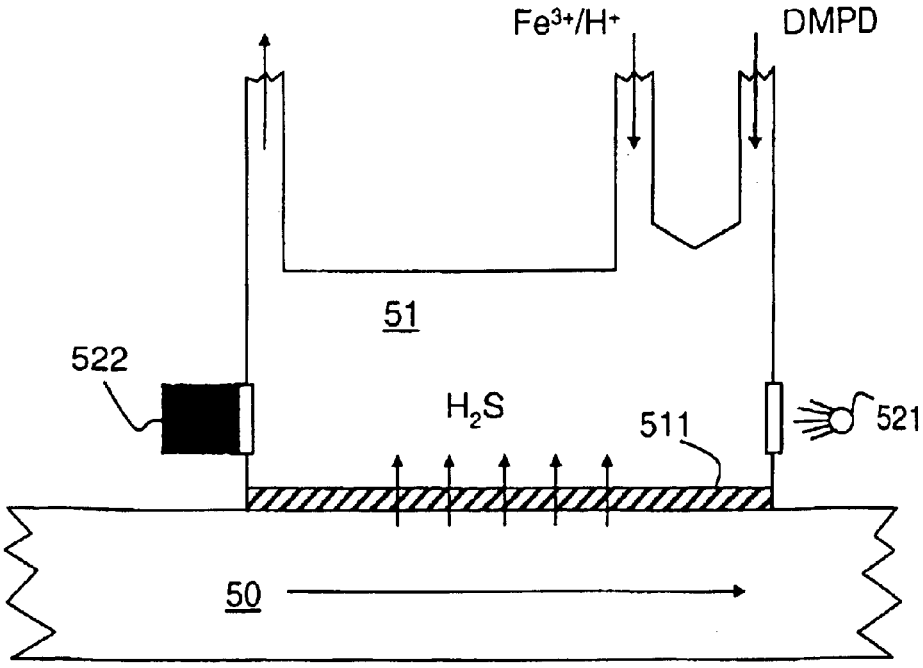
FIG. 5 is a schematic diagram of an optical sensor to determine the concentration of hydrogen sulphide in wellbore fluid samples.

The flux of hydrogen sulphide across the gas permeation membrane can also be measured by a suitable optical sensor as shown in FIG. 5. The hydrogen sulphide can react with a reagent that changes its optical properties, either by changing its absorbance (optical density) or its fluorescence activity. One application of an optical method to measure the flux of hydrogen sulphide across the gas permeation membrane 511 is the formation of methylene blue by reaction with iron(III) ions and N,N-dimethyl-p-phenylenediamine (DMPD) in an acidic aqueous solution. The reaction can be summarised by the reaction scheme:

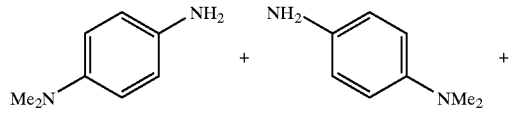

-continued

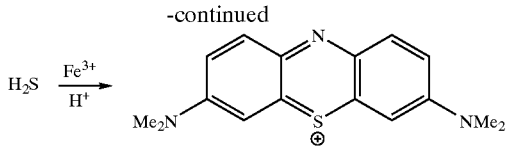

The methylene blue so formed can be detected by either fluorescence measurements or optical spectrophotometry. FIG. 5 shows a schematic of an optical sensor to measure the absorption of the methylene blue formed in a reaction chamber 51 as the hydrogen sulphide is extracted from a flowing wellbore fluid sample by the permeation membrane 511. The sensor is designed to enable separate solutions of acidified iron(III) ions and acidified DMPD to be mixed immediately prior to reaction with the hydrogen sulphide permeating through the separation membrane. The flow of the separated reagents into the optical cell 51 has two advantages. Firstly, separation of the Fe(III) ions and DMPD before reaction with hydrogen sulphide prevents loss of reactivity by ageing(60); secondly, the fresh solution that is used for each analysis of hydrogen sulphide removes the methylene blue formed by the previous analysis, thus minimising sample-to-sample contamination.

Immediately prior to the analysis of hydrogen sulphide content of a wellbore fluid sample, the optical chamber 51 is filled with a mixture of iron(III) ions and DMPD from the two separate flow streams. The composition of the acidified mixture has been determined by the flow rate and composition of the two reagent streams. The intensity of the light source 521 at some particular wavelength is measured through the flowing reaction mixture to ensure that it is substantially free of methylene blue. If the pH of the reaction solution in greater than unity, then the methylene blue so formed can be detected at an optical wavelength of 660 nm. When the intensity of the light in the flowing solutions reaches a constant value, this value is recorded as $I_o$ and the flow of the reaction mixture is stopped. The hydrogen sulphide diffusing across the membrane forms methylene blue and the intensity I of light at 660 nm reaching the detector 522 decreases. The absorbance A is defined by $$A = -\ln\left(\frac{I}{I_o}\right) \quad [29]$$

and is related to the molar concentration $C_D$ of methylene blue formed in the reaction mixture by the well-known Beer-Lambert law:

$$A = C_D l \epsilon \quad [30]$$

where l is the optical pathlength of the light in the reaction mixture and $\epsilon$ is the molar absorption coefficient of methylene at the selected wavelength. The measured rate of change of absorbance is given by $$\frac{dA}{dt} = l\varepsilon\frac{dC_D}{dt} = l\varepsilon V_o\frac{dn_D}{dt} \quad [31]$$

where $n_D$ is the number of moles of methylene blue formed in the volume of the reaction chamber $V_0$. The reaction is characterised by one mole of hydrogen sulphide forming one mole of methylene blue, and the combination of eqns. [24] and [31] yields $$C_L = \frac{M_w V_O L}{l\varepsilon D S_m}\frac{dA}{dt}. \quad [32]$$

The concentration of hydrogen sulphide in the reservoir fluid sample is therefore proportional to the rate of change of absorbance in the optical sensor.

The use of an optical sensor to measure the flux of hydrogen sulphide across the membrane can be illustrated with an example. A mixture of Fe(III) ions and DMPD in an acidic solution (pH=1.5) was reacted with hydrogen sulphide extracted from a flowing hydrocarbon sample by means of a membrane formed from polydimethylsiloxane. The diffusion coefficient of hydrogen sulphide through the membrane was $D=8.4\times10^{-9}$ $m^2/S$. The area of the membrane in contact with the hydrocarbon sample was $S_m=8$ $cm^2$ and its thickness was L=100 $\mu$m. The DMPD and iron(III) ions reacted with hydrogen sulphide in a reaction chamber of volume $V_0=10$ $cm^3$ and optical pathlength of l=6.5 cm and was detected at a wavelength of $\lambda=660$ nm, at which value the molar extinction coefficient of methylene blue was 9500 $m^2$/mole. The measured rate of change of absorbance was $dA/dt=0.0083$ $s^{-1}$, which, using eqn. [32], gave a concentration of $C_L=68$ ppm ($68\times10^{-6}$ $kg/m^3$) for the hydrogen sulphide in the reservoir fluid sample.

The optical technique can also be used to measure the concentration of hydrogen sulphide in water and gas samples. However, the concentration of $HS^-$ and $S^{2-}$ ions in water samples cannot he determined from this method unless their pH values are either measured or fixed.

c) Membrane-Coated Tape

Figure 6B:
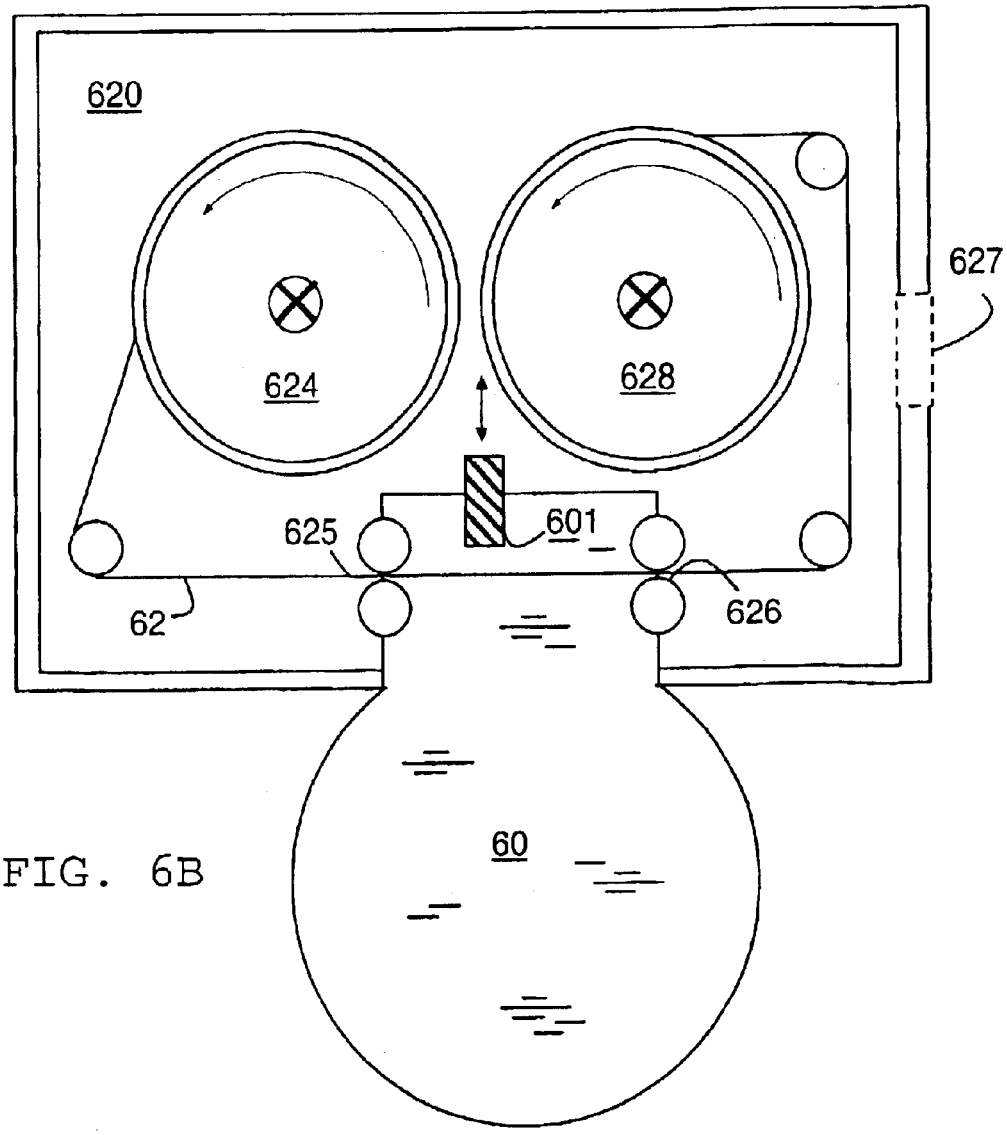
FIG. 6B is a schematic diagram of a lead acetate based sensor combined with an optical sensor to determine the concentration of hydrogen sulphide in wellbore fluid samples.
Figure 6A:
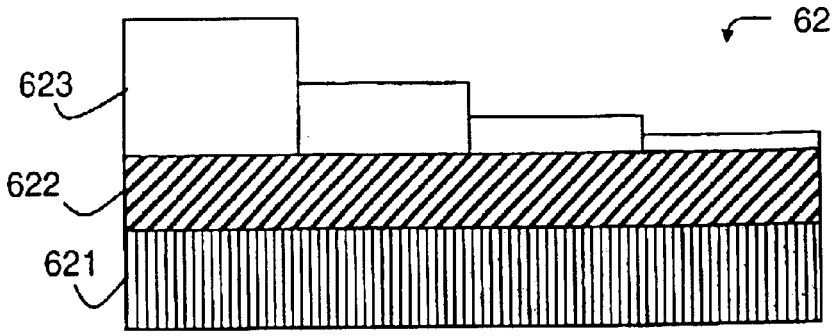
FIG. 6A shows details of a lead acetate based tape for use as downhole extraction and sensor system.

A variant of the membrane-based sensors in accordance with the invention is shown in FIGS. 6A and 6B.

In FIG. 6 the membrane is provided as part of the sensor. The sensor is a lead acetate (PbAc) reagent optically interrogated by a color sensitive device.

As shown in FIG. 6A, the PbAc reagent 622 can be coated or impregnated on a polymer tape substrate 621. The polymer tape is thin, flexible and of high tensile strength. It must also withstand borehole temperatures. Examples of such polymer are polyester and other materials used for the substrate of magnetic tapes or photo films. This high strength polymer substrate facilitates the delivery and retrieval of the PbAc reagent into and from the high-pressure flow line 60 in a controlled manner.

The PbAc reagent 622 can be laid onto the substrate either by using the commercially available test paper, or by using a mixture of fine PbAc powder and polymer binder. The polymer binder is permeable to the $H_2S$ but also water-resistant. The active side of the tape or surface will be covered with another layer of polymer 623 that is permeable to the $H_2S$ but less permeable to oil and water. This top polymer could be, but not necessarily, the same as the binding polymer. It protects the PbAc reagent 622 from water damage and functions as the membrane that separates the $H_2S$ from other components of the sample (e.g.,oil and/or water). Such protective layers for PbAc tapes are described for example in the U.S. Pat. No. 5,529,841.

The top layer polymer 623 serves not only as a membrane but also as a diffusion barrier for the $H_2S$ molecules, which slows down the reaction process. Its thickness determines the time that is required for the $H_2S$ molecules to diffuse through and reach the reagent. It therefore controls the speed of the reaction, hence the sensitivity of the tape. The governing relation is known as $$t = \frac{x^2}{D}, \quad [33]$$

where t is time, x the thickness of the barrier layer, and D the diffusion constant. According to a preferred embodiment of the invention, top layers of different thickness will run parallel along the PbAc tape. For instance, the sensing surface may be divided into four tracks with increasing thickness of the top layer 623 as shown in FIG. 5. A ratio of $1:10^{0.5}:10:1000^{0.5}$ in thickness for the four tracks will expand the detecting range by three orders of magnitude and give one decade of sensitivity suppression at each neighboring track. This will cover a detection range from 10 ppm to 10% of the $H_2S$ concentration, and hence provides a broad dynamic range.

One of the probable designs to deploy the PbAc sensing surface to the flow line is illustrated in FIG. 6B. The assembly is contained in a pressure-compensated chamber 620. The PbAc tape 62 runs from a supply spool 624 through a seal 625 into the flow line 60, where it rests for a certain period of (exposure) time. Chemical reaction will take place on the tape, should $H_2S$ be present in the flow line regardless the phase of the sample. The reaction turns the white tape (or a clear tape, depending on the substrate) into gray or brown.

The degree of grayness depends among other factors on the concentration of the $H_2S$. The exposed tape then returns to the chamber through another seal 626, where it is interrogated through a window 627 with a suitable optical detector (see below). After the measurement it is reeled onto a second spool 628.

The chamber 620 is preferably filled with a clear fluid of suitable viscosity (e.g., silicone gels), the pressure of which is kept the same with that of the flow line through a piston 601 moving between the flow line 60 and the chamber 620. Because of the pressure balance, the seals between the chamber and the flow line become less critical. The chamber fluid serves three functions: (1) it balances the pressure; (2) it isolates the virgin tape from the flow line sample before exposure; and (3) it serves as an optical couplant between the interrogation window 627 and the post exposure tape. The seals 625, 626 could be made of rubbery materials or PTFE. They allow the tape to slip through but retain the filling fluid. The seals also clean the tape surface 623 before and after the exposure. Both steps improve the consistency and the accuracy of the measurement.

To further reduce the possibility of contamination to the virgin tape 62, the active side 623 of the tape is wound inwards and additional partitions may be inserted around the supply spool 624.

The tape is driven by a mechanical power source at controlled speed. The power could come from a coil spring or an electrical motor at the flow line pressure, or could be delivered from inside the tool as long as a dynamic pressure seal can be achieved.

The interrogation is constituted with a reflectance and/or a transmission measurement. In either case, the optical source and signal are coupled to the tape through the window 627. Possible window materials are quartz and sapphire. Both have a superior mechanical strength and a suitable refractive index.

The actual interpretation of the signal requires calibration. Besides the concentration of the $H_2S$, the grayness of the exposed tape depends on the sample pressure, the temperature and the time duration of the exposure. In addition, variations in the fabrication of the tape and the optical interrogation system will also affect the outcome. Depending on the anticipated $H_2S$ concentration, the tracks on the tape can be tailored to render the maximum resolution.

Figure 7:
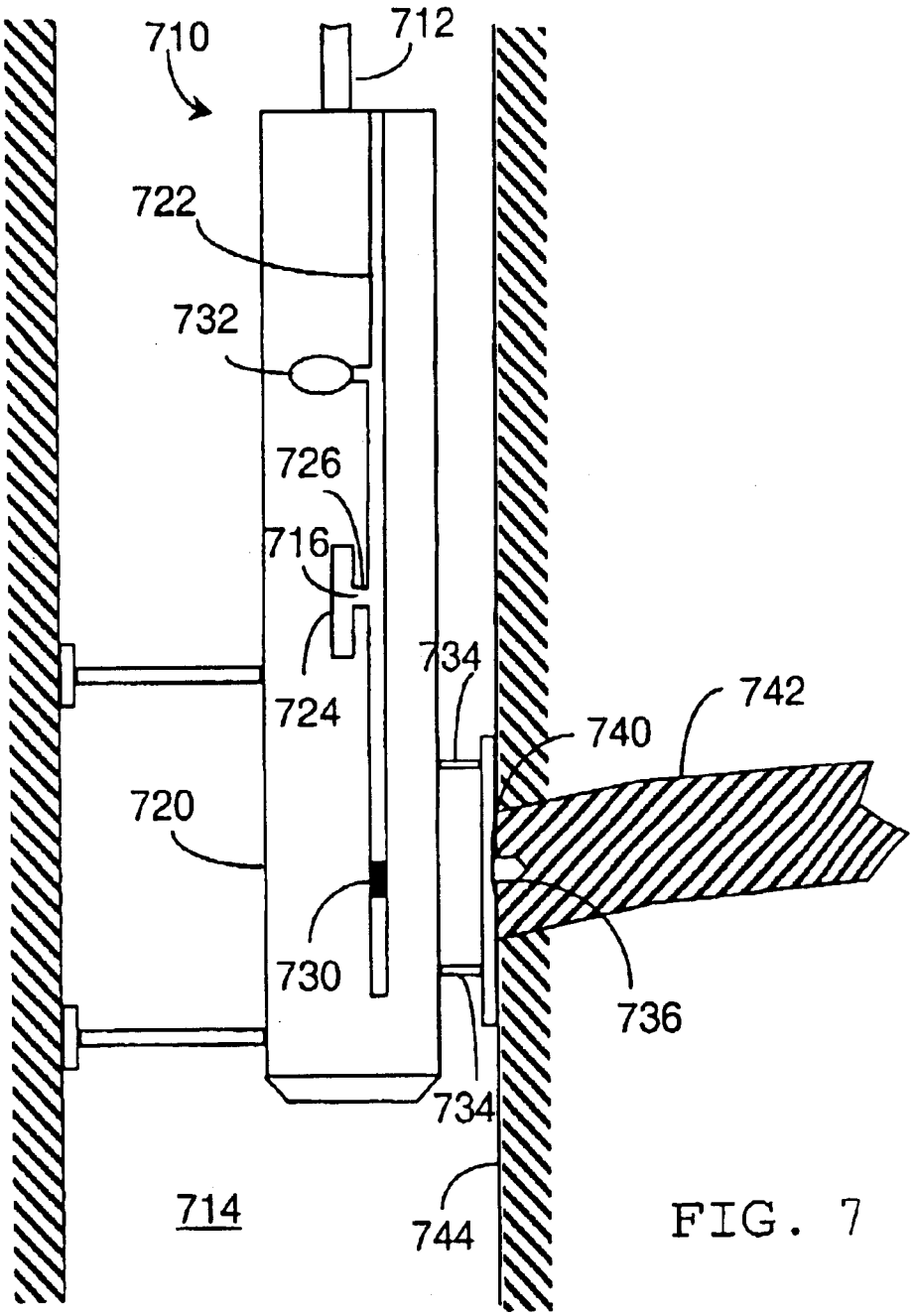
FIG. 7 shows a schematic diagram of a sampling apparatus with a hydrogen sulphide sensor system at a subterranean location.

FIG. 7 shows a testing apparatus adapted to carry a sensing device in accordance with the invention. The testing apparatus 710 is lowered on a wireline 712 within a wellbore 714. The testing apparatus 710 comprises a known modular dynamics tester as described in Trans. SPWLA 34th Ann. Logging Symp., Calgary, June 1993, paper ZZ, and as in the co-owned U.S. Pat. No. 3,859,851 to Urbanosky U.S. Pat. No. 3,780,575 to Urbanosky and U.S. Pat. No. 4,994,671 to Safinya et al. This known tester adapted by introduction of a testing chamber 716 which could be any of the hydrogen sulphide as described above. The modular dynamics tester comprises body 720 approximately 30 m long that contains a channel 722 passing along its length, a sampling bottle 724 around 0.3 m long attached to the channel 722 by conduit 726 in which sampling column 716 is placed. An optical fluid analyser 730 is within the lower part of the channel 722 and towards the upper end of the channel 722 a pump 732 is placed. Hydraulic arms 734 are attached external to the body 720 and carry a sample probe 736 for sampling fluid, about the base of which probe is an o-ring 740, or other seal.

Before completion of a well, the modular dynamics tester is lowered downhole on the wireline 712. When at the desired depth of a formation 742 which is to be sampled, the hydraulic arms 734 are extended until the sample probe 736 is pushed into and through a side wall 744 of the wellbore 714, and into the formation 742 which is to be analysed. The o-ring 740 at the base of the sample probe 736 forms a seal between the side of the wellbore 744 and the formation 742 into which the probe 736 is inserted and prevents the sample probe 736 from acquiring fluid directly from the borehole 714.

Once the sample probe 736 is inserted into the formation 742, an electrical signal is passed down the wireline 712 from the surface so as to start the pump 732 and to begin sampling of a sample of fluid from the formation 742. The sampled fluid passes through the channel or flow line 722. When passing the hydrogen sulphide sensor 724, $H_2S$ is extracted in a non-liquid form and detected in accordance with any one of the above described methods and sensors.

Various embodiments of the invention have been described. The descriptions are intended to be illustrative of the present invention. It will be apparent to those skilled in the art that modifications may be made to the invention as described without departing from the scope of the claims set out below.

References

1. Tissot, B. P. and Welte, D. H., *Petroleum Formation and Occurrence,* 2nd edition, pp. 453–455, Springer-Verlag, Berlin (1984).
2. Carlson, M. R. and Cawston, W. B., "Obtaining PVT data for very sour retrograde condensate gas and volatile oil reservoirs: A Multi-disciplinary approach", *SPE Gas Tech. Conf.*, Calgary, April–May 1996, SPE 35653.
3. Dosher, J. R. and Carney, J. T., "Sulfur increase seen mostly in heavy fractions of lower-quality crudes", *Oil & Gas J.,* 92, 42–48 (1994).
4. Goar, B. G. and Nasato, E., "Large-plant sulfur recovery processes stress efficiency", *Oil & Gas J.,* 92, 61–67 (1994).
5. Håland, K., Barrufet, H. P., Rønningsen, H. P. and Meisingset, K. K., "An empirical correlation between reservoir temperature and the concentration of hydrogen sulfide", 1999 *SPE Int. Symp. Oilfield Chem.*, Houston, Tex., February 1999, SPE 50763.

6. Orr, W. L. and Sinninghe Damsté, J. S., "Geochemistry of sulfur in petroleum systems" in *Geochemistry of Sulfur in Fossil Fuels*, (W. L. Orr and C. M. White, eds.), ACS Symposium Series 429, pp. 2–29, American Chemical Society, Washington, D.C. (1990).
7. Scott, P. J. B. and Davies, M., "Souring of New Irian Jaya wells traced to indigenous bacteria", *Oil & Gas J.,* 91, 47–50 (1993).
8. Aplin, A. C. and Coleman, M. L., "Sour gas and water chemistry of the Bridport Sands reservoir, Wytch Farm, UK" in *The Geochemistry of Reservoirs*, (J. M. Cubitt and W. A. England, eds.), pp. 303–314, Geol. Soc. Special Publication 86, The Geological Society, London (1995).
9. Kalpakci, B., Magri, N. F., Ravencroft, P. D., McTeir, M. D. K. and Arf, G. T., "Mitigation of reservoir souring—decision process", *SPE Int. Symp. Oilfield Chem.*, San Antonio, Tex., February 1995, SPE 28947.
10. Badry, R., Head, E., Morris, C. and Traboulay, I., "New wireline formation tester techniques and applications", *Trans. SPWLA 34th Ann. Logging Symp.*, Calgary, June 1993, paper ZZ.
11. Schlumberger, *Wireline Formation Testing and Sampling*, pp. 10–1 to 10–25, Schlumberger Wireline and Testing, Houston (1996).
12. Stokley, C. O. and Sanford, L., "Apparatus for obtaining subterranean fluid samples", U.S. Pat. No. 5,289,875, Mar. 1, 1994.
13. Michaels, J. M. and Leder, J. T., "Method and apparatus for acquiring and processing subsurface samples of connate fluid", U.S. Pat. No. 5,303,775, Apr. 19, 1994.
14. Rhodes, H. L., "Determination of hydrogen sulphide content in natural gas, evaluation of containers for preparation of calibration standards, and sample collection procedure", *US Dept. of the Interior, Bureau of Mines Report of Investigation*, No. 8391, Washington (1979).
15. Carlson, M. R. and Cawston, W. B., "Obtaining PVT data for very sour retrograde condensate gas and volatile oil reservoirs: A multi-disciplinary approach", *SPE Gas Tech. Conf.*, Calgary, April–May 1996, SPE 35653.
16. U.K. Patent No. 2344365B entitled "Downhole Sampling Tool and Method".
17. Massie, K. J., Brown, J. W. and McGilvray, J. A., "Well fluid sampling tool", U.S. Pat. No. 5,337,822, Aug. 16, 1994.
18. Burke, N. E., Chea, C. K, Hobbs, R. D. and Tran, H. T., "Extended analysis of live reservoir oils by gas chromatography", *SPE Int. Symposium Oilfield Chem.*, Anaheim, Calif., February 1991, SPE 21003.
19. Cutter, G. A. and Oatts, T. J., "Determination of dissolved sulfide and sedimentary sulfur speciation using gas chromatography-photoionization detection", *Anal. Chem.,* 59, 717–721 (1987); Cutter, G. A. and Krahforst, C. F., "Sulfide in surface waters of the western Atlantic Ocean", *Geophys. Res. Letts.,* 15, 1393–1396 (1988).
20. Radford-Knœry, J. and Cutter, G. A., "Determination of carbonyl sulfide and hydrogen sulfide species in natural waters using specialized collection procedures and gas chromatography with flame photometric detection", *Anal. Chem.* 65, 976–982 (1993).
21. Devai, I. and DeLaune, R. D., "Changes in reduced gaseous sulfur compounds collected in glass sampling bulbs", *Anal. Letts.,* 27, 2403–2411 (1994).
22. Bethea, R. M., "Comparison of hydrogen sulfide analysis techniques", *J. Air Poll. Control Assoc.,* 23, 710–713 (1973).
23. Masselter, S. M., Zemann, A. J. and Bonn, G. K., "Determination of inorganic anions in Kraft pulping liquors by capillary electrophoresis", *J. High Resol. Chromatogr.,* 19, 131–136 (1996).
24. Font, J., Gutierrez, J., Lalueza, J. and Perez, X., "Determination of sulfide in the leather industry by capillary electrophoresis", *J. Chromatogr. A.,* 740, 125–132 (1996).
25. Yashin, A. Y. and Belymova, T. T., "Simultaneous determination of sulfide, iodide and rhodanide by ion chromatography with the use of an amperometric detector", *J. Anal. Chem.,* 53, 344–346 (1998).
26. Hassan, S. M., "Sulfur speciation: methodology and application to sulfide oxidation studies at the sediment-water interface", *Chemosphere,* 12, 2555–2569 (1994).
27. Nagashima, K., Fukushima, K. and Kamaya, M., "Determination of trace amounts of sulphide in serum by high-performance chromatography with fluorometric detection after derivatization with 2-amino-5-N,N-diethylaminotoluene and iron(III)", *J. Liquid Chromatogr.,* 18, 515–526 (1995).
28. Garrett, R. L., "A new field method for the quantitative determination of sulfides in water-based drilling fluids", *J. Pet. Tech.*, September 1977, pp. 1195–1202.
29. API, *Recommended Practice Standard Procedure for Field Testing Water-Based Drilling Fluids*, API Recommended Practice 13B-1 (RP 13B-1), 1st ed., American Petroleum Institute, Washington, D.C. (1990).
30. Barrett, E. P. S., Georgiades, G. C. and Sermon, P. A., "The mechanism of operation of $WO_3$-based $H_2S$ sensors", *Sensors Actuators B: Chemical*, B1, 116–120 (1990).
31. Tamaki, J., Maekawa, T., Miura, N. and Yamazoe, N., "CuO—$SnO_2$ element for highly sensitive and selective detection of $H_2S$", *Sensors Actuators B: Chemical*, B9, 197–203 (1992).
32. Sberveglieri, G., Groppelli, S., Nelli, P., Perego, C., Valdré, G. and Camanzi, A., "Detection of sub-ppm $H_2S$ concentrations by means of $SnO_2$(Pt) thin films, grown by the RGTO technique", *Sensors Actuators B: Chemical*, B15–16, 86–89 (1993).
33. Mochida, T., Kikuchi, K., Kondo, T., Ueno, H. and Matsuura, Y., "Highly sensitive and selective $H_2S$ gas sensor from r.f. sputtered $SnO_2$ thin film", *Sensors Actuators B: Chemical*, B24–25, 433–437 (1995).
34. Galipeau, J. D., Falconer, R. S., Vetelino, J. F., Caron, J. J., Wittman, E. L., Schweyer, M. G. and Andle, J. C., "Theory, design and operation of a surface acoustic wave hydrogen sulfide microsensor", *Sensors Actuators B: Chemical, B*24–25, 49–53 (1995).
35. Schiavon, G., Zotti, G., Toniolo, R. and Bontempelli, G., "Electrochemical detection of trace hydrogen sulfide in gaseous samples by porous silver electrodes supported on ion-exchange membranes (solid polymer electrolytes)", *Anal. Chem.,* 67, 318–323 (1995).
36. Hart, J. P. and Abass, A. K., "A disposable amperometric gas sensor for sulfur-containing compounds based on a chemically modified screen printed carbon electrode coated with hydrogel", *Anal. Chim. Acta,* 342, 199–206 (1997).
37. Revsbech, N. P., Jørgensen, B. B. and Blackburn, T. H., "Microelectrode studies of the photosynthesis and $O_2$, $H_2S$ and pH profiles of a microbial mat", *Limnol. Oceanogr.,* 28, 1062–1074 (1983).
38. Vivit, D. V., Ball, J. W. and Jenne, E. A., "Specific-ion electrode determinations of sulfide preconcentrated from San Francisco Bay waters", *Environ. Geol. Water Sci.,* 6, 79–90 (1984).
39. Eckert, W., Frevert, T. and Trüper, H. G., "A new liquid-junction free probe for the in situ determination of pH, $pH_2S$ and redox values", *Wat. Res.,* 24, 1341–1346 (1990).

40. Dobcnik, D., Gomiscek, S. and Stergulec, J., "Preparation of a sulphide ion-selective microelectrode with chemical pretreatment of silver wire in Hg(II) solution", *Fresenius J. Anal. Chem.,* 337, 369–371 (1990).

41. Rey, J. R., Shaffer, J., Kain, T., Stahl, R. and Crossman, R., "Sulfide variation in the pore and surface waters of artificial salt-marsh ditches and a natural tide creek", *Estuaries,* 15, 257–269 (1992).

42. Brouwer, H. and Murphy, T. P., "Diffusion method for the determination of acid-volatile sulfides (AVS) in sediment", *Environ. Toxicol. Chem.,* 13, 1273–1275 (1994).

43. Hu, X. and Leng, Z., "Determination of trace-levels of sulfide by high-sensitivity potentiometry with a carbon paste electrode", *Anal. Commun.,* 33, 297–298 (1996).

44. Hadden, D. H., "A system for continuous on-site measurement of sulfides in water-based drilling muds", *SPE Sour Gas Symp.*, Tyler, Tex., November 1977, SPE 6664.

45. Jeroschewski, P., Haase, K., Trommer, A. and Gründer, P., "Galvanic sensor for the determination of hydrogen sulphide/sulphide in aqueous media", *Fresenius J. Anal. Chem.,* 346, 930–933 (1993); Jeroschewski, P., Haase, K., Trommer, A. and Gründer, P., "Galvanic sensor for determination of hydrogen sulphide", *Electroanalysis,* 6, 769–772 (1994); Jeroschewski, P., Steuckart, C. and Kuhl, M., "An amperometric microsensor for the determination of $H_2S$ in aquatic environments", *Anal. Chem.,* 68, 4351–4357 (1996).

46. Ma, Y. L., Galal, A., Zimmer, H., Mark, H. B., Huang, Z. F. and Bishop, P. L., "Potentiometric selective determination of hydrogen sulfide by an electropolymerized membrane electrode based on binaphthyl-20-crown-6", *Anal. Chim. Acta,* 289, 21–26 (1994).

47. Atta, N. F., Galal, A., Mark, H. B., Yu, T and Bishop, P. L., "Conducting polymer ion sensor electrodes-III. Potentiometric sulfide ion selective electrode", *Talanta,* 47, 987–999 (1998).

48. Opekar, F. and Bruckenstein, S., "Determination of gaseous hydrogen sulfide by cathodic stripping voltammetry after preconcentration on a silver metalized porous membrane electrode", *Anal. Chem.,* 56, 1206–1209 (1984).

49. Kirchnerova, J., Bale, C. W. and Skeaff, J. M., "Potentiometric gaseous sulfur sensor based on silver beta-alumina solid electrolyte", *Solid State Ionics,* 91, 257–264 (1996).

50. Weldon, V., O'Gorman, J., Phelan, P., Hegarty, J. and Tanbuk-Ek, T., "$H_2S$ and $CO_2$ gas sensing using DFB laser diodes emitting at 1.57 μm", *Sensors Actuators B: Chemical*, B29, 101–107 (1995).

51. Smits, A. R., Fincher, D. V., Nishida, K., Mullins, O. C., Schroeder, R. J. and Yamate, T., "In-situ optical fluid analysis as an aid to wireline formation sampling", *SPE Formation Evaluation,* 10, 91–98 (1995).

52. Arowolo, T. A. and Cresser, M. S., "Automated determination of sulphide by gas-phase molecular absorption spectrometry", *Analyst,* 116, 595–599 (1991).

53. Howard, A. G. and Yeh, C. Y., "Sulfide measurement by flow injection analysis with flame photometric detection", *Anal. Chem.,* 70, 4868–4872 (1998).

54. Saltzman, R. S. and Leonard, L. M., "Sulfur recovery tail gas analyses with a process diode array analyzer", personal communication.

55. Suleimenov, O. M. and Seward, T. M., "A spectrophotometric study of hydrogen sulphide ionisation in aqueous solutions to 350° C.", *Geochim. Cosmochim. Acta,* 61, 5187–5198 (1997).

56. Parks, R. E., "Chemiluminescent sulfur detection apparatus and method", U.S. Pat. No. 4,678,756, Jul. 7, 1987.

57. Hager, R. N., "Methods and apparatus for making chemical concentration measurements in a sub-surface exploration probe ", U.S. Pat. No. 5,351,532, Oct. 4, 1994.

58. Cline, J. D., "Spectrophotometric determination of hydrogen sulphide in natural waters", *Limnol. Oceaonogr.,* 14, 454–458 (1969).

59. Francom, D., Goodwin, L. R. and Dieken, F. P. "Determination of low level sulfides in environmental waters by automated gas dialysis/methylene blue colorimetry", *Anal. Letts.,* 22, 2587–2600 (1989).

60. Kubán, V., Dasgupta, P. K. and Marx, J. N., "Nitroprusside and methylene blue methods for silicone membrane differentiated flow injection determination of sulfide in water and wastewater", *Anal. Chem.,* 64, 36–43 (1992).

61. Habicht, K. S. and Canfield, D. E., "Sulfur isotope fractionation during bacterial sulfate reduction in organic-rich sediments", *Geochim. Cosmochim. Acta,* 61, 5351–5361 (1997).

62. Spaziani, M. A., Davis, J. L., Tinani, M. and Carroll, M. K. "On-line determination of sulphide by the 'methylene blue method' with diode-laser-based fluorescence detection", *Analyst,* 122, 1555–1558 (1997).

63. Phillips, B. M., Anderson, B. S. and Hunt, J. W., "Measurement and distribution of interstitial and overlying water ammonia and hydrogen sulfide in sediment toxicity tests", *Marine Environ. Res.,* 44, 117–126 (1997).

64. Koh, T., Takahashi, N., Yamamuro, N. and Miura, Y., "Spectrophotometric determination of sulfide at the $10^{-6}$ mol $l^{-1}$ level by the formation of thiocyanate and its solvent extraction with methylene blue", *Anal. Sci.,* 9, 487–492 (1993).

65. Mousavi, M. F. and Sarlack, N., "Spectrophotometric determination of trace amounts of sulfide ion based on its catalytic reduction reaction with methylene blue in the presence of Te(IV)", *Anal. Letts.,* 30, 1567–1578 (1997).

66. Shanthi, K. and Balasubramanian, N., "Method for sampling and analysis of hydrogen sulphide", *Analyst:,* 121, 647–650 (1996).

67. Narayanaswamy, R. and Sevilla, F., "Optosensing of hydrogen sulphide through paper impregnated with lead acetate", *Fres. Z. Anal. Chem.,* 329, 789–792 (1989).

68. Neihof, R. A., "Hydrogen sulfide analyzer with protective barrier", U.S. Pat. No. 5,529,841, Jun. 25, 1996.

69. Eroglu, A. E., Volkan, M., Bayrahm, E., Ataman, O. Y. and Mark, H. B., "Hydrogen sulfide determination by solid surface luminescence", *Fres. J. Anal. Chem.,* 355, 667–671 (1996).

70. Volkan, M., Eroglu, T., Eroglu, A. E., Ataman, O. Y. and Mark, H. B., "A novel sorbent tube for ambient hydrogen sulfide determination", *Talanta,* 47, 585–593 (1998).

71. Cardoso, A. A., Liu, H. and Dasgupta, P. K., "Fluorimetric fiber optic drop sensor for atmospheric hydrogen sulfide", *Talanta,* 44, 1099–1106 (1997).

72. Choi, M. M. F., "Fluorimetric optode membrane for sulfide detection", *Analyst,* 123, 1631–1634 (1998).

73. Lessard, R. B. and Ramesh, M., "Method for detection of sulfides", U.S. Pat. No. 5,397,708, Mar. 14, 1995.

74. McCulloch, S., Stewart, G. and Culshaw, B., "Optical waveguide sensors for hydrogen sulphide", *Final Report OSCA Contract* 114/*Strathclyde*, Doc. No. 93/52F, September 1993.

75. Weirich, J. B., Bland, R. G., Smith, W. W., Kreuger, V., Harrell, J. W., Natr, H. and Papayan, V., "Drilling system with sensors for determining properties of drilling fluid downhole", International Patent Application WO 99/00575, 7 Jan. 1999.

76. Hachenberg, H. and Schmidt, A. P., *Gas Chromatography Headspace Analysis*, Wiley, Chichester (1984).

77. Ioffe, B. V. and Vitenberg, A. G., *Head-Space Analysis and Related Methods in Gas Chromatography*, Wiley-Interscience, New York (1984).

78. Kolb, B. and Ettre, L. S., *Theory and Practice of Static Headspace Gas Chromatography*, Wiley-VCH, Chichester (1997).

79. Vitenberg, A. G., Kuznetsova, L. M., Butaeva, I. L. and Inshakov, M. D., "Gas chromatographic determination of trace amounts of sulfur compounds in industrial effluents", *Anal. Chem.,* 49, 128–133 (1977).

80. Brunner, U., Chasteen, T. G., Ferloni, P. and Bachofen, R., "Chromatographic determination of phosphine ($PH_3$) and hydrogen sulfide ($H_2S$) in the headspace of anaerobic bacterial enrichment using flame photometric detection", *Chromatographia,* 40, 399–403 (1995).

81. Ramstad, T., Bates, A. H., Yellig, T. J., Borchert, S. J. and Mills, K. A., "Analysis of hydrogen sulphide gas from a pharmaceutical drug formulation by cryofocused headspace gas chromatography", *Analyst,* 120, 2775–2780 (1995).

82. Ref. 78, pp. 268–270.

83. Schultz, R. L. and Bohan, W. L., "Downhole fluid property measurement tool", U.S. Pat. No. 5,329,811, Jul. 19, 1994.

84. Yesudas, M., Michaels, J. M., Rafie, S. and Shwe, T., "Determining fluid properties from pressure, volume, and temperature measurements made by electric wireline formation testing tools", U.S. Pat. No. 5,635,631, Jun. 3, 1997.

85. Kurosawa, H., Hirano, T., Nakamura, K. and Amano, Y., "Microbial sensor for selective determination of sulphide", *Appl. Microbiol. Biotechnol.,* 41, 556–559 (1994).

86. Mariani, D and Mullins, O., "Detection of hydrogen sulfide via millimeter wave spectroscopy", *Schlumberger-Doll Research Note*, EMG-003, Aug. 14, 1990; Mariani, D and Mullins, O., "Millimeter wave sulfide detector", *Schlumberger-Doll Research Patent Memorandum*, Aug. 14, 1992.

87. Dake, L. P., *The Practice of Reservoir Engineering*, pp. 29–44, Elsevier, Amsterdam (1994).

88. Parrillo, D. J., Thaeron, C. and Sircar, S., "Separation of bulk hydrogen sulfide—hydrogen mixtures by selective surface flow membrane", *A.I.Ch.E.J.,* 43, 2239–2245 (1997).

89. Tremper, K. K. and Prausnitz, J. M., "Solubility of inorganic gases in high-boiling hydrocarbon solvents", *J. Chem. Eng. Data,* 21, 295–299 (1976).

90. King, M. B. and Al-Najjar, H., "The solubilities of carbon dioxide, hydrogen sulphide and propane in some normal alkane solvents—I", *Chem. Eng. Sci.,* 32, 1241–1246 (1977).

91. Yokoyama, C., Usui, A. and Takahashi, S., "Solubility of hydrogen sulfide in isooctane, n-decane, n-tridecane, n-hexadecane and squalane at temperatures from 323 to 523 K and pressures up to 1.6 MPa", *Fluid Phase Equilibria,* 85, 257–269 (1993).

92. Feng, G-X. and Mather, A. E., "Solubility of hydrogen sulfide in n-eicosane at elevated pressures", *J. Chem. Eng. Data,* 37, 412–413 (1992); Feng, G-X. and Mather, A. E., "Solubility of $H_2S$ in n-dodecane", *Fluid Phase Equilibria,* 87, 341–346 (1993); Feng, G-X. and Mather, A. E., "Solubility of $H_2S$ in n-hexadecane at elevated pressures", *Can. J. Chem. Eng.,* 71, 327–328 (1993); Feng, G-X., Mather, A. E. and Carroll, J. J., "The solubility of hydrogen sulfide in mixtures of n-hexadecane and n-eicosane", *Can. J. Chem. Eng.,* 73, 154–155 (1995).

93. Carroll, J. J. and Mather, A. E., "The solubility of hydrogen sulphide in water from 0 to 90° C. and pressures to 1 MPa", *Geochim. Cosmochim Acta,* 53, 1163–1170 (1989).

94. Myers, R. J., "The new value for the second dissociation constant for $H_2S$", *J. Chem. Educ.,* 63, 687–690 (1986).

95. Suleimenov, O. M. and Krupp, R. E., "Solubility of hydrogen sulfide in pure water and in NaCl solutions, from 20° C. to 320° C. and at saturation pressures", *Geochim. Cosmochim. Acta,* 58, 2433–2444 (1994).

96. Shorthouse, G. and Peat, R., "Down hole chemical sensors for sub-sea wells", *MST News,* 2, 12–13, August 1998.

97. Bates, R. G., "The glass electrode", in *Reference Electrodes* (D. J. G Ives and G. J Janz, eds.), pp. 238–240, Academic Press, London (1961).

98. Quinn, R. and Laciak, D. V., "Polyelectrolyte membranes for acid gas separations", *J. Membrane Sci.,* 131, 49–60 (1997).

99. Stern, S. A. and Bhide, B. D., "Permeability of silicone polymers to ammonia and hydrogen sulfide", *J. Applied Polymer Sci.,* 38, 2131–2147 (1989).

What is claimed is:

1. A method of detecting hydrogen sulphide in formation fluid samples comprising the steps of:

positioning a downhole tool having a body and an extendible conduit member within a subterranean wellbore;

bringing a distal opening of said conduit member in contact with formation surrounding said subterranean wellbore;

allowing formation fluid to pass from a location within said formation into said body of said downhole tool;

extracting from said formation fluid hydrogen sulphide into an extraction volume wherein the extraction volume comprises a reactant for creating reaction products of hydrogen sulfide;

providing at least one sensor system responsive to a chemical compound comprising reaction products of hydrogen sulphide within said extraction volume;

using said sensor system to determine the presence and/or amount of hydrogen sulphide in said formation fluid.

2. The method of claim 1 wherein the extraction volume is substantially void of formation fluid in a liquid state.

3. The method of claim 1 wherein in the extraction volume the pressure of a sample of the formation fluid is reduced below its bubble point pressure, thereby generating a phase boundary.

4. The method of claim 3 wherein in the extraction volume the pressure of the formation fluid is reduced below its bubble point pressure by the steps of isolating the sample of the formation fluid and expanding the volume of the isolated sample.

5. The method of claim 4 comprising the step of retracting a piston from an initial location adjacent to a wall of the conduit to a final position within the extraction volume thereby expanding the volume of the extraction volume.

6. The method of claim 1 wherein the extraction volume is created by providing within the body of the tool a volume and a membrane separating said volume and the formation fluid wherein the membrane is at least partly Permeable for hydrogen sulphide.

7. The method of claim 1 wherein the extraction volume is created by providing within the body of the tool a membrane-coated tape comprising a hydrogen sulphide sensitive components and using the body of the membrane as extraction volume.

8. The method of claim 1 further comprising the step of continuously or discontinuously renewing at least part of the sensors system without retrieval of the tool to a surface location.

9. The method of claim 8 comprising the step of continuously or discontinuously supplying reactants to the extraction volume, said reactants being capable of reacting with hydrogen sulphide.

* * * * *